US010842713B1

(12) United States Patent
Cohen et al.

(10) Patent No.: US 10,842,713 B1
(45) Date of Patent: Nov. 24, 2020

(54) LOCKABLE CONTAINER

(71) Applicant: Secure Medication Systems, LLC, Fort Collins, CO (US)

(72) Inventors: Milton Cohen, Greenwood Village, CO (US); Keir Hart, Lafayette, CO (US); Daniel Estoque, Boulder, CO (US)

(73) Assignee: Secure Medication Systems, LLC, Fort Collins, CO (US)

( * ) Notice: Subject to any disclaimer, the term of this patent is extended or adjusted under 35 U.S.C. 154(b) by 0 days.

(21) Appl. No.: 16/541,868

(22) Filed: Aug. 15, 2019

(51) Int. Cl.
*A61J 1/03* (2006.01)
*E05B 37/02* (2006.01)
*B65D 55/14* (2006.01)

(52) U.S. Cl.
CPC ..... *A61J 1/03* (2013.01); *B65D 55/14* (2013.01); *B65D 55/145* (2013.01); *E05B 37/02* (2013.01); *E05Y 2900/602* (2013.01)

(58) Field of Classification Search
CPC .... B65D 55/14; B65D 55/145; E05B 37/0048
See application file for complete search history.

(56) References Cited

U.S. PATENT DOCUMENTS

| | | | | |
|---|---|---|---|---|
| 841,668 | A | 1/1907 | Cowles | |
| 3,405,828 | A | 10/1968 | St. Pierre | |
| 3,782,574 | A | 1/1974 | Rumble | |
| 3,830,394 | A | 8/1974 | Lestaevel | |
| 5,520,305 | A | 5/1996 | Pierson | |
| 5,927,529 | A | 7/1999 | Hofmann et al. | |
| 7,252,204 | B1 | 8/2007 | Small | |
| 8,875,915 | B2 | 11/2014 | Serell | |
| 8,939,301 | B1 | 1/2015 | Small | |
| D741,713 | S | 10/2015 | Serell | |
| D742,116 | S | 11/2015 | Serell | |
| D746,058 | S | 12/2015 | Serell | |
| D747,606 | S | 1/2016 | Serell | |
| D747,607 | S | 1/2016 | Serell | |
| 9,890,558 | B2 | 2/2018 | Serell | |
| 2011/0210136 | A1 | 9/2011 | Wang | |
| 2013/0062303 | A1* | 3/2013 | Serell | A61J 1/03 215/206 |
| 2015/0300045 | A1* | 10/2015 | Serell | E05B 37/0048 81/15.9 |
| 2018/0280246 | A1 | 10/2018 | Cohen et al. | |
| 2019/0100364 | A1 | 4/2019 | Bolen | |

FOREIGN PATENT DOCUMENTS

| | | | |
|---|---|---|---|
| EP | 0043859 | A1 | 1/1982 |
| EP | 0620162 | A1 | 10/1994 |

* cited by examiner

*Primary Examiner* — Jeffrey R Allen
(74) *Attorney, Agent, or Firm* — Goodwin Procter LLP

(57) ABSTRACT

A lockable container for securing items or objects, the container including a first element, which may include a cylindrical member and a retainer for capturing two or more rotatable rings on the cylindrical member, and a second element, which is mateable with the first element, cooperating with the rings to close an open end of the cylindrical member of the first element.

24 Claims, 19 Drawing Sheets

LOCKABLE CONTAINER

FIELD OF THE INVENTION

The present invention relates to an improved lockable container and, more specifically, to a lockable container having first and second mateable elements that can be manufactured in such a manner as to facilitate unlocking the container.

BACKGROUND

Tamper-proof or child-resistant containers, such as those used, for example, for distributing pharmaceutical medications, are widely used to restrict access to the contents. To provide greater security, especially for controlled substances, locking caps with selectively-programmable rings may be used. For example, U.S. Pat. No. 8,875,915 ("Container having a Programmable Combination Locking Cap"), issued to Secure Medication System, LLC of Fort Collins, Colo. and incorporated in its entirety herein by reference, describes a number of embodiments of containers that include individually programmable combination locking caps. In some embodiments, the locking cap includes a number of rotatable rings that may be aligned adjacent to one another on the cap.

According to some embodiments of the '915 patent, tabs formed on the inner surface of these rings operate in conjunction with projections formed on a canister portion of the container to allow/prevent the cap from being removed from the canister portion. Access to the contents contained in the canister portion is made possible, however, by removing one tab on each ring, so that there is nothing to interfere with the projections when the plural rings are positioned so that the removed tabs are aligned along a vertical axis associated with the projections. To facilitate aligning the rings to unlock the cap and canister portion, alphanumerical indicia may be formed on the outer surface of the ring. The indicia that position the removed tabs along the vertical axis associated with the projections on the canister portion correspond to the combination code for unlocking the container. In some implementations, the consumer may create her own combination code; in other implementations, the pharmacist may create the combination code.

In some implementations (e.g., containers for medications), the corresponding industry and customary sizes that consumers are familiar with may dictate the size of future canister and cap combinations. As a result, whereas a combination code having three or more digits (on three or more rings) may be more secure than a combination code having just two digits (on two rings), because the size of the container and the portion of that overall size that may be available for the rotatable rings may be standardized, having more rings may mean that the rings are less wide than solutions with fewer rings. Problematically, some consumers may find it more difficult to see the alphanumerical indicia on the less wide rings than on wider rings. These same and other consumers may also find it more difficult to manipulate the less wide rings than the wider rings. Furthermore, rotating three or more rings requires aligning a combination code that includes an equal number of alphanumerical indicia. Disadvantageously, rotating one ring may affect the alignment of adjacent rings (e.g., due to "sticky" rings), requiring the process to take longer and the rings having to be moved back and forth to provide an exact alignment.

Tolerances in manufacturing of, for example, the caps, the rotatable rings, the tabs on the rings, the flanges, and the canister portion, as well as the number of rotatable rings, may make unlocking the cap and canister combination, as well as opening the container, more difficult. This phenomenon may be referred to as ring indexing tolerance. Ring indexing tolerance may manifest among senior consumers whose eyesight or digital dexterity may not permit or may prolong a perfect alignment of the combination code. Alternatively, or in addition, the relative alignment of the alphanumerical indicia on outer surface of the ring with the tabs on the inner surface of the ring during manufacture may be off sufficiently, such that, even if combination code is properly aligned along the vertical axis of the projections formed on the canister portion, one or more tabs may interfere with the projections, preventing removal of the cap from the canister portion.

Finally, single-piece caps for containers often include, for holding the rings, a cylindrical member that is slightly tapered. In some instances, the tapering may induce some free play in the rings, affecting the ability to exactly align the appropriate combination code.

SUMMARY OF THE INVENTION

Advantageously, it would be beneficial to provide a container having a locking programmable feature that does not suffer from ring indexing tolerance and/or that eliminates the tapering of the cylindrical member holding the rotatable rings by providing a cylindrical member having a uniform diameter.

In a first aspect, the present invention relates to a lockable container. In some embodiments, the lockable container may include a first element that includes: a cylindrical member having a first open end at a proximal end thereof and a second open end at a distal end thereof, at least two rings rotatably supported by the cylindrical member, and a retainer for capturing the rings on the cylindrical member and covering the first open end and a second element mateable with the first element and that includes structure that cooperates with the rings to close the second open end to control access to an interior of the container. In some applications, the height of the first element is greater than the height of the second element. In other applications, the height of the first element is substantially equal to the height of the second element. While, in still other applications, the height of the first element is less than the height of the second element.

In some variations, the first element may be a canister and the second element may be a cap, such that the cap closes the second open end when the canister and cap are mated, while, in other variations, the first element may be the cap and the second element may be the canister, such that the cap covers an open end of the canister when the canister and the cap are mated.

In some implementations, the cylindrical member may include an annular flange formed at the second open end for retaining the rings. Rings may be provided on the cylindrical member for setting a combination code for locking the cylindrical member to the second element and each ring includes an outer peripheral surface and an inner peripheral surface, wherein identification elements are formed on the outer peripheral surface of the rings and corresponding selectively removable tabs are formed on the inner peripheral surface of the rings.

In some variations, the retainer may include: a sidewall portion having a proximal end and a distal end; a closed end formed at the proximal end; an open end at the distal end; and an annular flange formed at the open end for retaining the rings. The retainer may be fixedly attached to the cylindrical member.

In some implementations, the second element may be structured and arranged to slidingly fit inside the cylindrical member. The second element may include a cylindrical member having a first open end and a second closed end and projections formed on an exterior surface thereof. In some variations, the second closed end may include a belled portion and a lower portion of the belled portion may be structured and arranged to rest on an annular flange formed at the second open end of the cylindrical member. The projections may be structured and arranged to slidingly pass through an unlocking opening formed in the cylindrical member when a combination code is selected on the rings.

In a second aspect, the present invention relates to a method of controlling access to contents within a lockable container. In some embodiments, the method may include: providing a lockable container having a first element and a second element. The first element may include a cylindrical member having a first open end at a proximal end thereof and a second open end at a distal end thereof, at least two rings rotatably supported by the cylindrical member, and a retainer for capturing the rings on the cylindrical member and covering the first open end. The second element may be mateable with the first element and may include structure that cooperates with the rings to close the second open end to control access to an interior of the container. In some variations, the second element may be structured and arranged to slidingly fit inside the cylindrical member of the first element and/or a first second element of a first container is structured and arranged to slidingly fit inside a second element of a second container.

The method may further include one or more of: fixedly attaching the retainer to the cylindrical member, forming an unlocking opening and multiple alignment openings in the cylindrical member, forming an annular flange on the second open end of the cylindrical member to retain the rings, and/or forming projections on an exterior surface of the second element. In some variations, the projections are structured and arranged to slidingly pass through an unlocking opening formed in the cylindrical member when a combination code is selected on the rings. The rings may be for setting a combination code for locking the cylindrical member to the second element, each ring having an outer peripheral surface and an inner peripheral surface, wherein plural identification elements are formed on the outer peripheral surface and plural selectively removable tabs are formed on the inner peripheral surface.

In some applications, providing the retainer may include providing a sidewall portion having an open end at a distal end thereof, forming a closed end at a proximal end of the sidewall portion, and/or forming an annular flange at the open end of the sidewall portion for retaining the ring.

BRIEF DESCRIPTION OF THE DRAWINGS

Various features and advantages of the present invention, as well as the invention itself, can be more fully understood from the following description of the various embodiments, when read together with the accompanying drawings, in which.

DETAILED DESCRIPTION

Figure 1A:
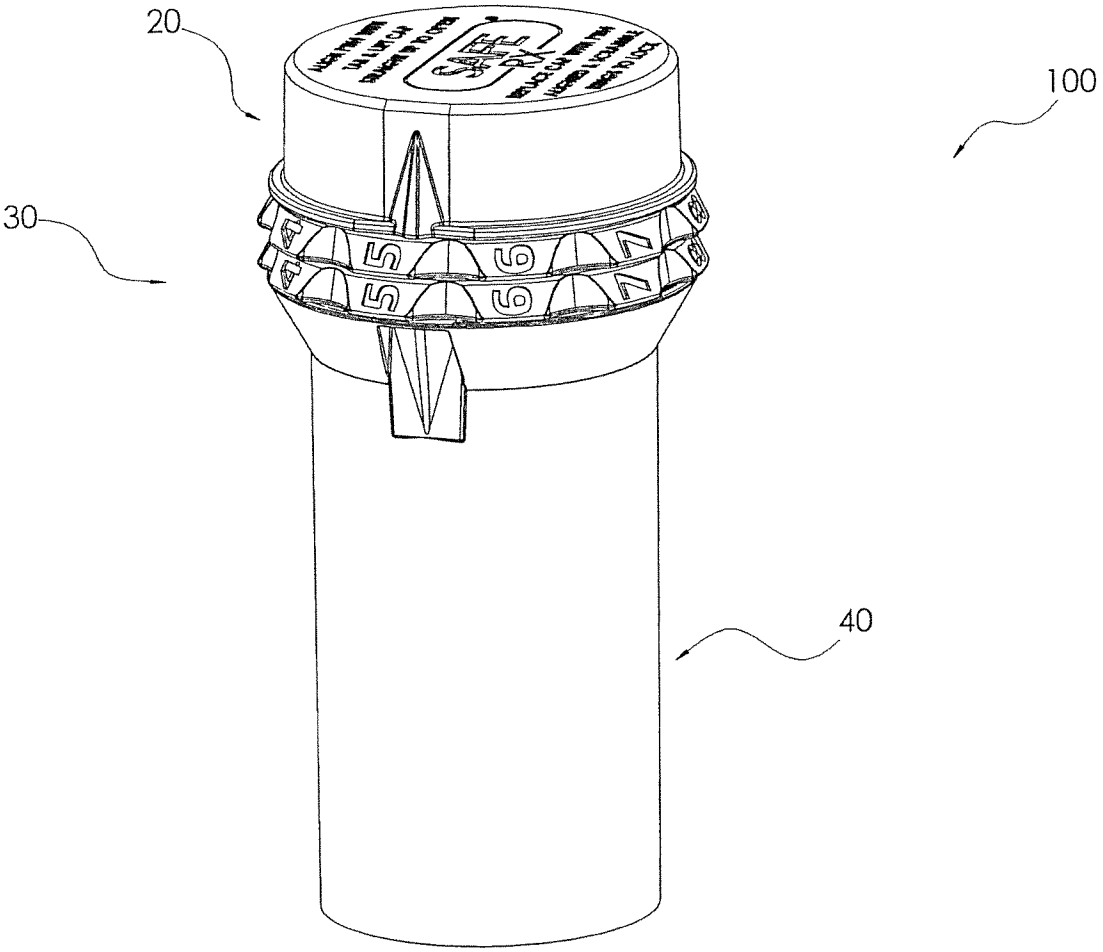
FIG. 1A shows an isometric view of a first embodiment of a container in accordance with some embodiments of the present invention.
Figure 1B:
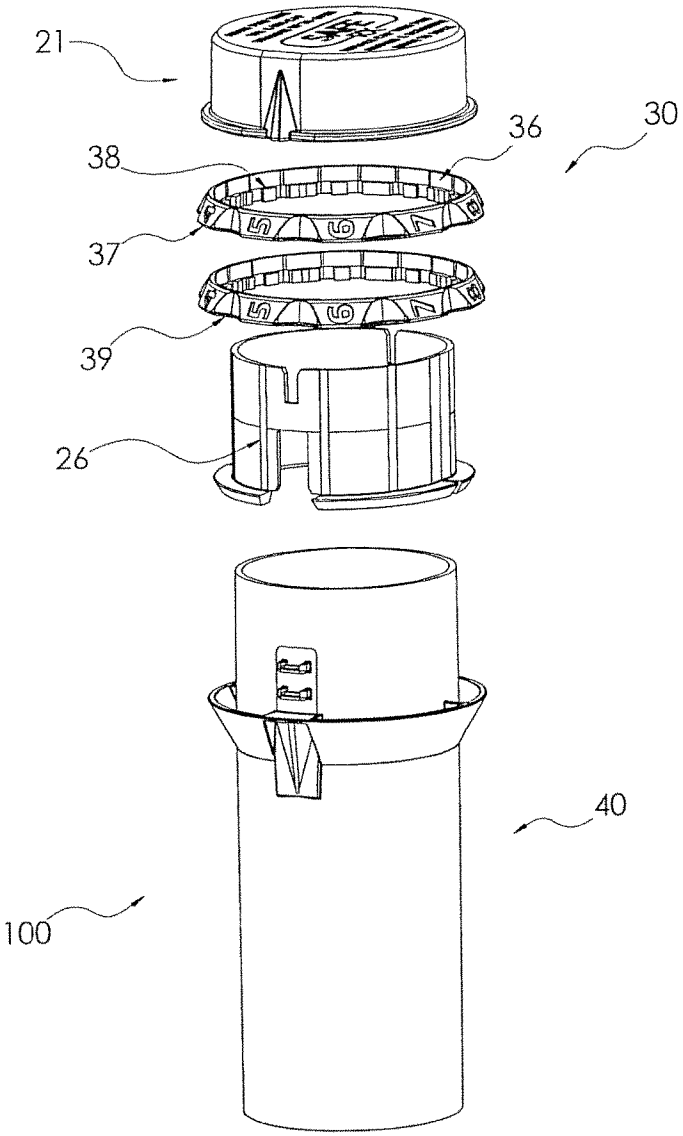
FIG. 1B shows an exploded view of the first embodiment of the container shown in FIG. 1A in accordance with some embodiments of the present invention.
Figure 2:
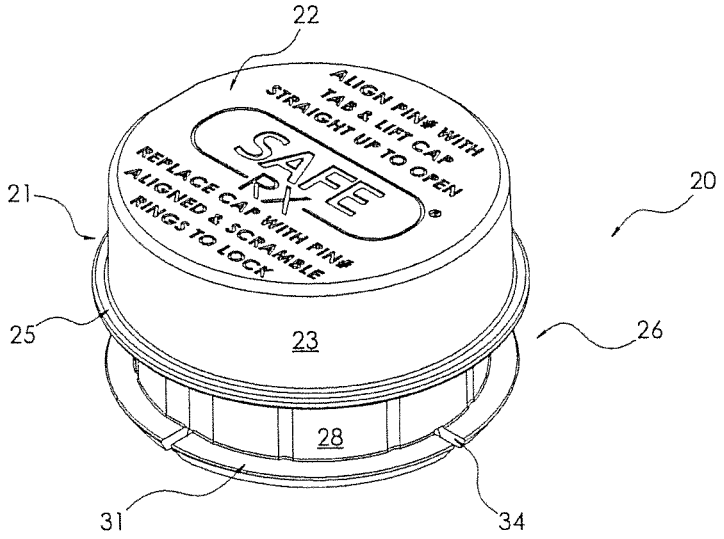
FIG. 2 shows an isometric view of a first element for the container shown in FIG. 1A in accordance with some embodiments of the present invention.

Referring to FIGS. 1A and 1B, respectively, isometric and exploded views of a first embodiment of a lockable programmable container 100 are shown. In some embodiments, the lockable programmable container 100 may include a first element 20, a plurality of rotatable rings 30, and a second element 40. Preferably, the first element 20 includes multiple portions, e.g., a retainer 21 and a cylindrical member 26. Advantageously, for this first embodiment, the multi-piece (i.e., two-piece) first element 20 may be structured and arranged to be used as the cap of the container 100. While any number of rotatable rings 30 may be used, two rings 30 are shown in the figures and are preferred. For the first embodiment, the rotatable rings 30 are operatively disposed on the cap portion of the container 100; for the second embodiment, discussed below, the rotatable rings 30 are operatively disposed on the canister portion of the container 100.

As shown in FIG. 1B, the rotatable rings 30 are annular, having an inner surface 36 and an outer surface 37. In some implementations, a plurality of removable tabs 38 may be formed on the inner surface 36 of each ring 30, while an alphanumeric character 39 may be located on the outer surface 37 of each ring 30. The alphanumerical characters 39 enable the consumer, pharmacist, or authorized third party to create a multi-digit (e.g., a two-digit) combination code for the purpose of locking and selectively unlocking the container 100 (by re-entering the appropriate combination code). Preferably, the size and location of each alphanumerical character 39 on the outer surface 37 of the ring 30 corresponds to a discrete removable tab 38 formed on the inner surface 36 of the ring 30. The inner diameter of the ring 30 may be designed so that, once the rings 30 are placed on the cylindrical member 26, the rings 30, and especially the removable tabs 38 on the inner surface 36, will rotate smoothly about the circumference of the cylindrical member 26. Removal of the tabs 38 and creation of a combination code are discussed below.

FIGS. 2-4B show an illustrative first element 20 that functions as the cap of a container 100 in accordance with the first embodiment of the present invention. According to the first embodiment, the first element 20 includes a retainer 21 and a cylindrical member 26. Preferably the height of the retainer 21 is the same, substantially the same, or less than the height of the cylindrical member 26. The retainer 21 may be manufactured (e.g., by extrusion, molding, 3D-printing, casting, and the like) from, for example, plastic, metal, composites, or other materials while the cylindrical member 26 may be manufactured (e.g., by extrusion, molding, 3D-printing, casting, of the like) from, for example, plastic, metal, composites, or other materials. In some implementations, the retainer 21 may be fixedly attached to the cylindrical member 26 adhesively, by ultrasonic welding, by solvent bonding, and the like.

In some applications, the retainer 21 includes a fully closed first end 22 and an open second end 24 created by a (e.g., annular) sidewall 23 extending perpendicularly or substantially perpendicularly from the closed first end 22. Alignment indicia (e.g., an arrow, a line, a triangle, and the like) may be formed on the sidewall 23 and/or on the closed first end 22 for the purpose of aligning the first element 20 with the second element 40 to lock/unlock the canister 100. In some variations, a flange 25 may be formed on the sidewall 23 about the open second end 24. Advantageously, the flange 25 may be provided to retain the rotatable rings 30 on the cylindrical member 26.

In some embodiments, the cylindrical member 26 includes an annular sidewall 28 having a first opening 27 (e.g., at a distal end thereof) and a second opening 29 (e.g., at an opposing, proximal end thereof). Advantageously, in some applications, the cylindrical member 26 may be configured to provide a uniform diameter between the openings 27, 29. For some applications, however, the annular sidewall may be slightly tapered towards the first opening 27. Because the diameter of the cylindrical member 26 is configured to be uniform (rather than to taper), the shrink rate of a flange during manufacture may become inconsequential.

In some variations, a flange 31 may be formed on the sidewall 28 about the second opening 29. Advantageously, the flange 31 may be provided to retain the rotatable rings 30 on the cylindrical member 26. In some embodiments, breaks 34 may be provided in the flange 25, so that the flange 25 is discontinuous. In some variations, the breaks 34 in the flange 25 are configured to be mateable with corresponding protrusions, projections, ribs 48, and the like formed in the second element 40.

Figure 3:
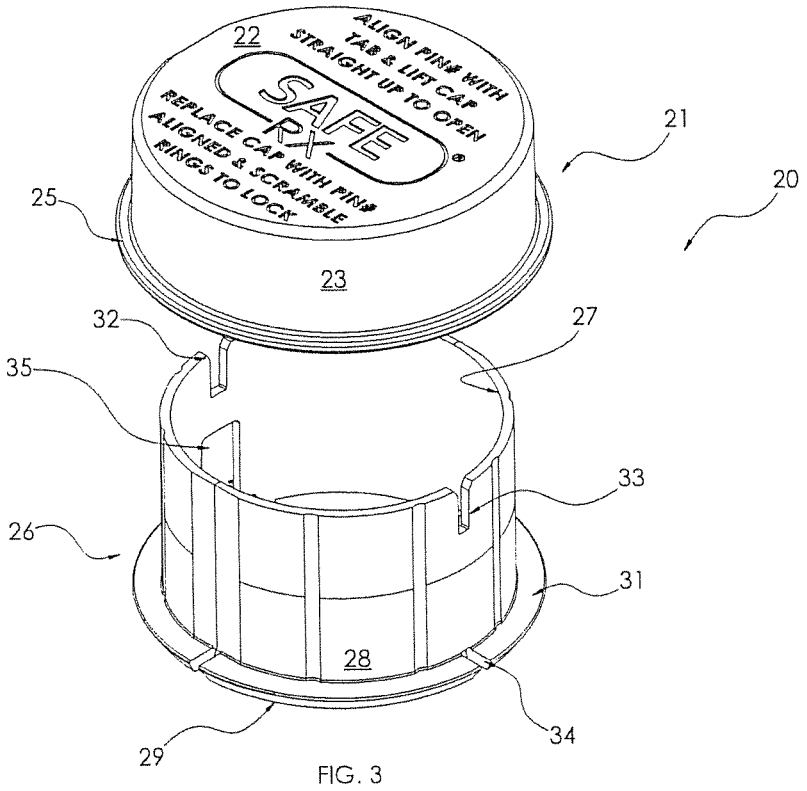
FIG. 3 shows an exploded view of the first element for the container shown in FIG. 2 in accordance with some embodiments of the present invention.
Figure 4B:
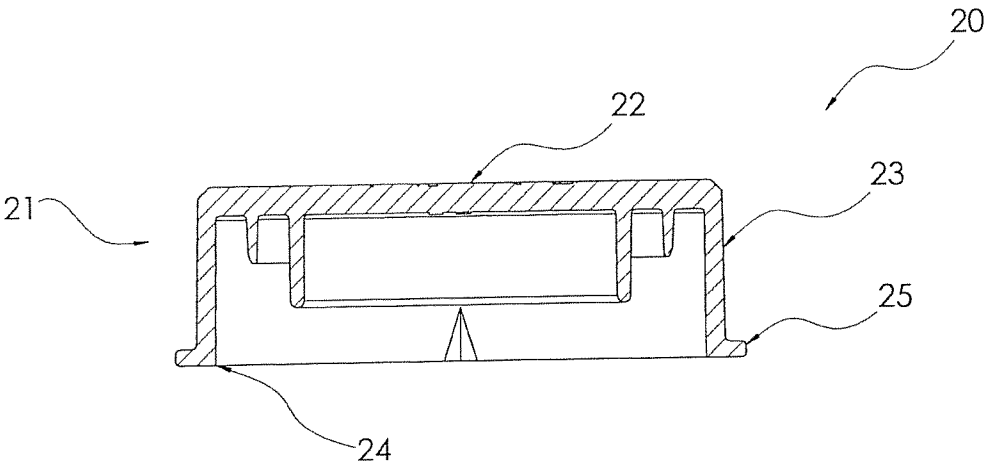
FIG. 4B shows a side cross-sectional view of the first element for the container taken along the 4B-4B axis shown in FIG. 4A in accordance with some embodiments of the present invention.
Figure 4B:
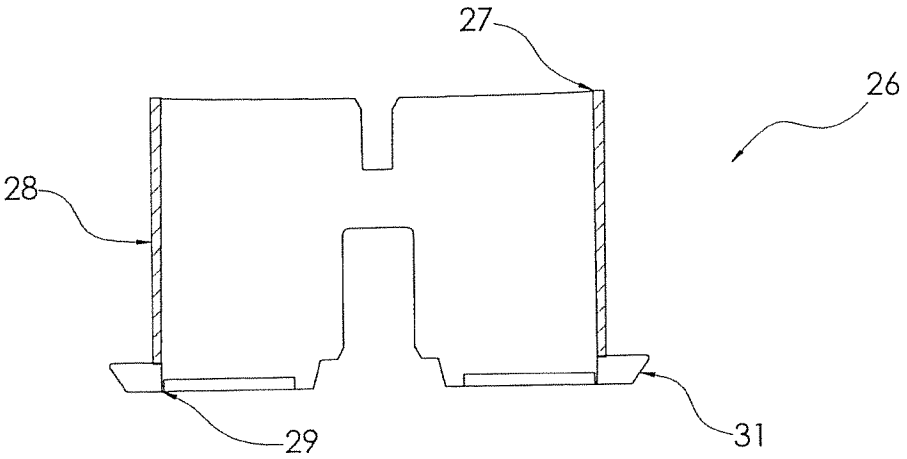
Figure 4A:
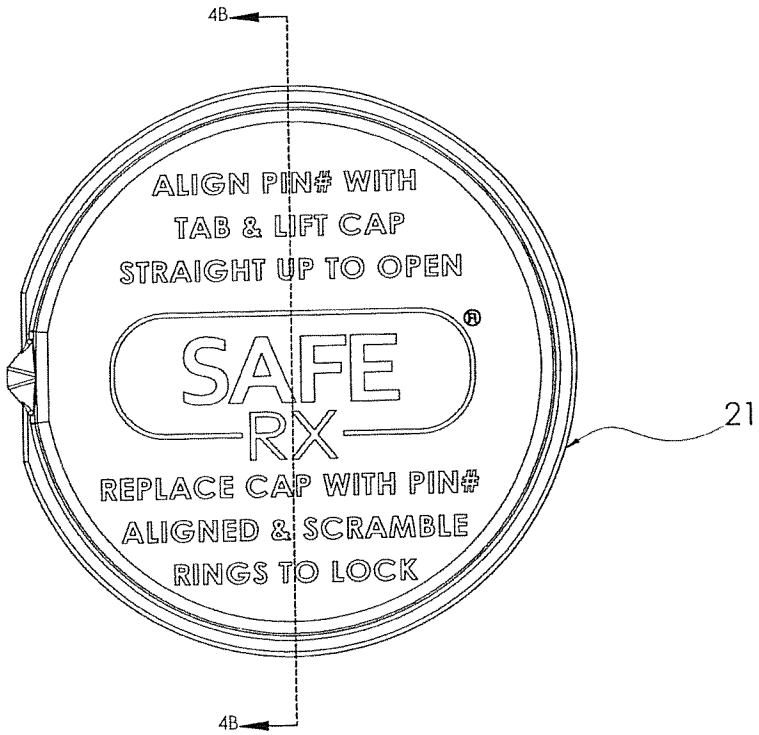
FIG. 4A shows a top (plan) view of the first element for the container shown in FIG. 2 in accordance with some embodiments of the present invention.

A first notch 32 and a second notch 33 may be formed in the sidewall 28 of the cylindrical member 26, such that the notches 32, 33 are configured to extend (e.g., in an axial or longitudinal direction) from the first opening 27 towards the second opening 29. Although FIG. 3 shows two first notches 32, 33, that is done for the purpose of illustration rather than limitation. More or fewer notches may be formed in the sidewall 28 of the cylindrical member 26. Moreover, although the first notch 32 and the second notch 33 shown in FIG. 3 appear to be diametrically opposed to one another about the sidewall 28 of the cylindrical member 26, that is also done for the purpose of illustration rather than limitation. The first notch 32 and the second notch 33 may be formed on the sidewall 28 of the cylindrical member 26 anywhere about the first opening 27.

In some variations, the first notch 32 and second notch 33 are structured and arranged to be mateable with corresponding projections, protrusions, or the like formed on the inner surface of the sidewall 23 of the retainer 21 and may provide points for fixedly joining (e.g., adhesively, by ultrasonic welding, by solvent bonding, and the like) the retainer 21 and the cylindrical member 26.

In some implementations, an unlocking opening 35 may also be formed in the sidewall 28 of the cylindrical member 26. The unlocking opening 35 is structured and arranged to provide a window or channel in the cylindrical member 26 that is adapted to accommodate a plurality of projections 44, 45 formed on the second element 40. The interaction between the projections 44, 45 and the removable tabs 38 located on the inner surface 36 of the rotatable rings 30 may be used to securely lock the first element 20 and the second element 40. Preferably, the unlocking opening 35 is structured and arranged to extend (e.g., in a longitudinal or axial direction) from the second opening 29, through the flange 31, towards the first opening 27, terminating at a location close to, near, or proximate the first opening 27. More preferably, the unlocking opening 35 extends from the second opening 29, through the flange 31, to a location in the sidewall 28 that just permits the consumer, pharmacist, or other authorized third party to access (as is described in greater detail below) the corresponding tabs 38, so as to allow the consumer, pharmacist, or other authorized third party to remove the tabs 38 corresponding to the combination code from the inner surfaces 36 of the rotatable rings 30. As shown in FIG. 3B, the unlocking opening 35 may also be configured to be proximate one of the notches 32. However, this is done for the purpose of illustration only. Indeed, the unlocking opening 35 may be formed anywhere in the sidewall 28 of the cylindrical member 26.

In some variations, the unlocking opening 35 may be structured and arranged so as to align with the alignment indicia disposed on the sidewall 23 or on the closed first end 22 of the retainer 21. The unlocking opening 35 may also be designed to provide a constant thickness (i.e., width) and a constant height (i.e., length).

Figure 5:
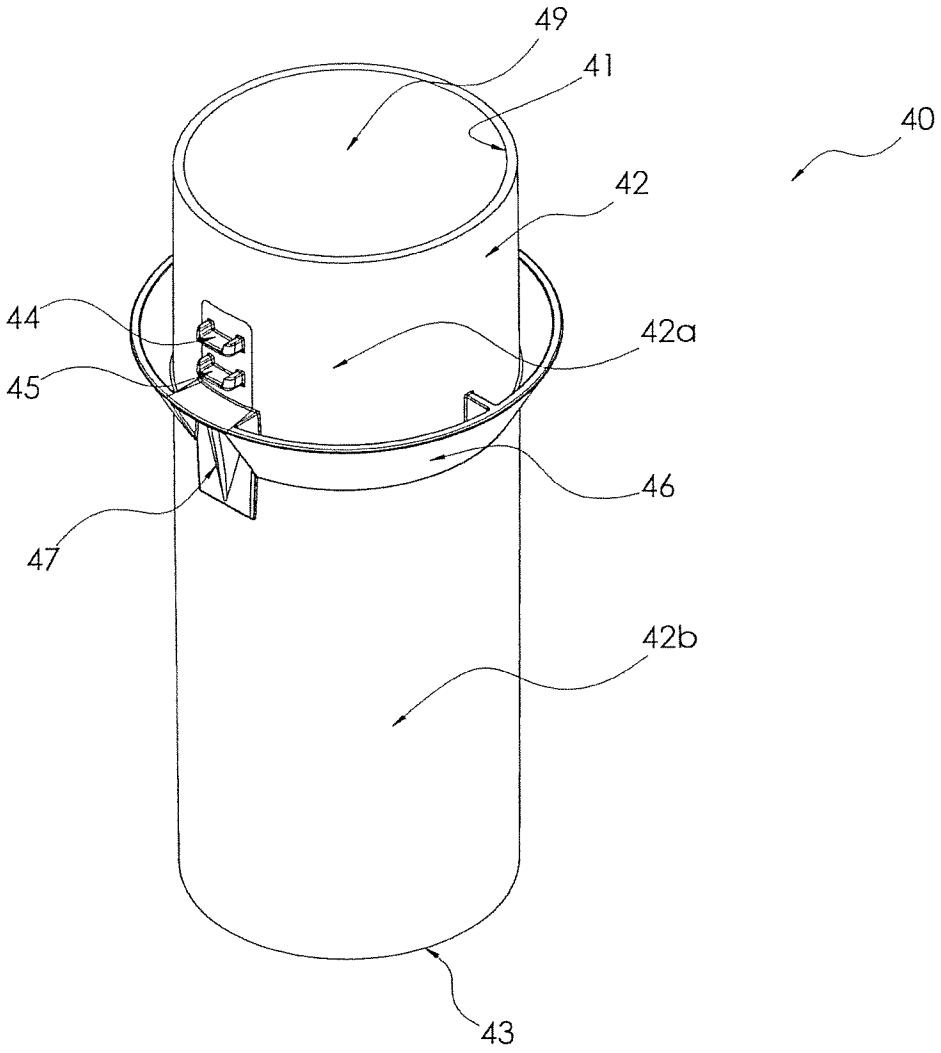
FIG. 5 shows an isometric view of a second element for the container shown in FIG. 1A in accordance with some embodiments of the present invention.

Referring to FIG. 5, an illustrative embodiment of a second element 40 for use with a first element 20 and rotatable rings 30 in connection with a locking container 100 is shown. Although the embodied second element 40 is shown as having a cylindrical shape, that is done for illustrative purposes only. In any of its various implementations, portions of the second element 40 may take on any practical structural or aesthetic shape. In some embodiments, the second element 40 includes an open first end 41, a sidewall 42, and a completely closed second end 43 to provide a hollow canister that provides a plenum 49 for storage of the contents of the container 100.

In some applications, the sidewall 42 may include an upper (e.g., cylindrical) portion 42*a* and a lower portion 42*b*. Preferably, the outer diameter of the upper portion 42*a* of the sidewall 42 is designed to be slightly less than the inner diameter of the second opening 29 of the cylindrical member 26 of the first element 20, so that the second element 40, and more specifically, the upper portion 42*a* of the sidewall 42 of the second element 40 may slide or slip, without excessive frictional resistance, within the second opening 29 of the cylindrical member 26 of the first element 20. Although the lower portion 42*b* may also be cylindrical in shape, it does not have to be.

In some variations, a plurality of projections 44, 45 may be formed on the upper portion 42*a* of the sidewall 42, so as to project therefrom. The number of projections 44, 45 may correspond to the number of rotatable rings 30; hence, for the two-ring container 100 shown in FIG. 1A, the total number of projections 44, 45 is two. In some embodiments, the projections 44, 45 are cubical or substantially cubical, C-shaped (as shown), I-shaped, or a combination thereof.

Optionally, to prevent unauthorized personnel from looking between the first element 20 and the second element to observe when empty tab spaces on the rotatable rings 30 are aligned within the unlocking opening 35, a belled portion 46 may be formed to project out from the sidewall 42 of the second element 40, e.g., at a short distance below the final projection 45. The belled portion 46 may, in some variations, provide a delineation between the upper portion 42*a* and the lower portion 42*b* of the sidewall 42 of the second element 40. In some applications, a plurality of protrusions, projections, ribs 48, and the like may be formed within the belled portion 46 for the purpose of mating with corresponding breaks 34 in the flange 31 of the cylindrical member 26 of the first element 20.

The belled portion 46 may serve as or provide a blocking function to prevent unauthorized personnel from looking between the first element 20 and the second element 40 to try to align the open or empty spaces, corresponding to where tabs 38 have been removed, on the inner surface 36 of the rotatable rings 30 within the unlocking opening 35. As an alternative to a belled portion, if the shape and size of the lower portion 42*b* of the sidewall 42 is much greater than that of the upper portion 42*a*, then the lower portion 42*b* may provide the blocking function to prevent unauthorized personnel from looking between the first element 20 and the second element 40 to try to align the open or empty spaces in the rotatable rings 30 within the unlocking opening 35. Alternatively, an additional projection (e.g., a blocker) may be formed on the upper portion 42*a* of the sidewall 42 of the second element 40.

In normal operation, some portion of the projections 44, 45 formed on the upper portion 42*a* of the second element 40 may be provided to (e.g., structurally) engage (i.e., interfere with) tabs 38 disposed on the inner surface 36 of the rotatable rings 30 to securely lock the first element 20 to the second element 40 until the appropriate combination code has been dialed up (e.g., entered) on the rotatable rings 30. Once the appropriate combination code has been dialed up (e.g., entered) on the rotatable rings 30, the open or empty spaces provided by the tabs removed when establishing the combination code should be properly aligned within the unlocking opening 35, so that the cylindrical member 26 of the first element 20 may be removed from about the upper portion 42*a* of the sidewall 42 of the second element 40.

In some implementations, alignment indicia 47 (e.g., an arrow, a triangle, a line, and the like) may also be formed on the lower portion 42*b* of the sidewall 42 of the second element 40 and/or on the belled portion 46. In some embodiments, the alignment indicia 47 aligns with and points towards the projections 44, 45 formed in the upper portion 42*a* of the second element 40. In some variations, once the upper portion 42*a* of the sidewall 42 of the second element 40 is inserted into the second opening 29 of the cylindrical member 26 of the first element 20, such that the projections 44, 45 and the unlocking opening 35 are aligned for either locking or unlocking the container 100, the alignment indicia formed on the closed first end 22 and/or formed on the sidewall 23 of the retainer 21 of the first element 20 and the alignment indicia 47 formed on the sidewall 42 and/or on the belled portion 46 of the second element 40 may themselves be aligned. Scrambling or rotating the rings 30 from this alignment position securely locks the container 100, preventing unauthorized personnel from accessing the contents of the container 100. In order to unlock the container 100 to access the contents, the consumer or authorized user may merely rotate the rings 30 to dial up (e.g., enter) the appropriate combination code between the alignment indicia formed on the retainer 21 of the first element 20 and alignment indicia 47 formed on the sidewall 42 and/or on the belled portion 46 of the second element 40.

Figure 6A:
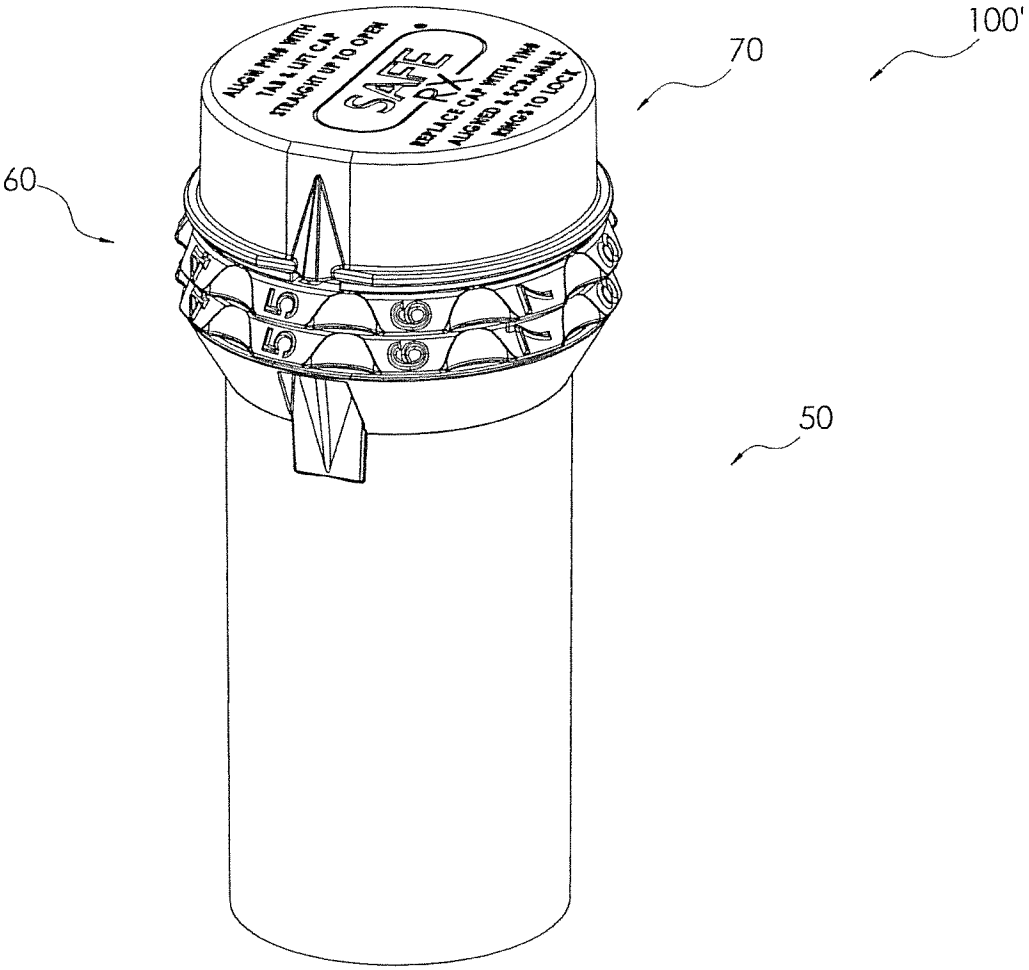
FIG. 6A shows an isometric view of a second embodiment for a container in accordance with some embodiments of the present invention.
Figure 6C:
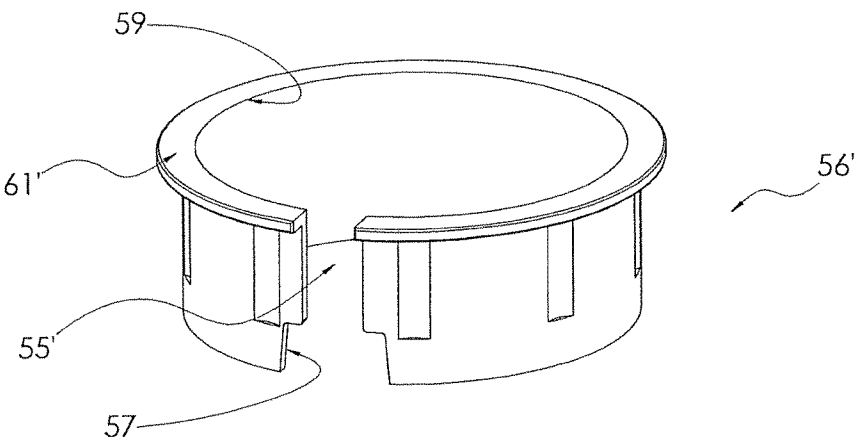
FIG. 6C shows an isometric view of another embodiment of a cylindrical member for the first element of the container shown in FIG. 6A in accordance with some embodiments of the present invention.
Figure 6B:
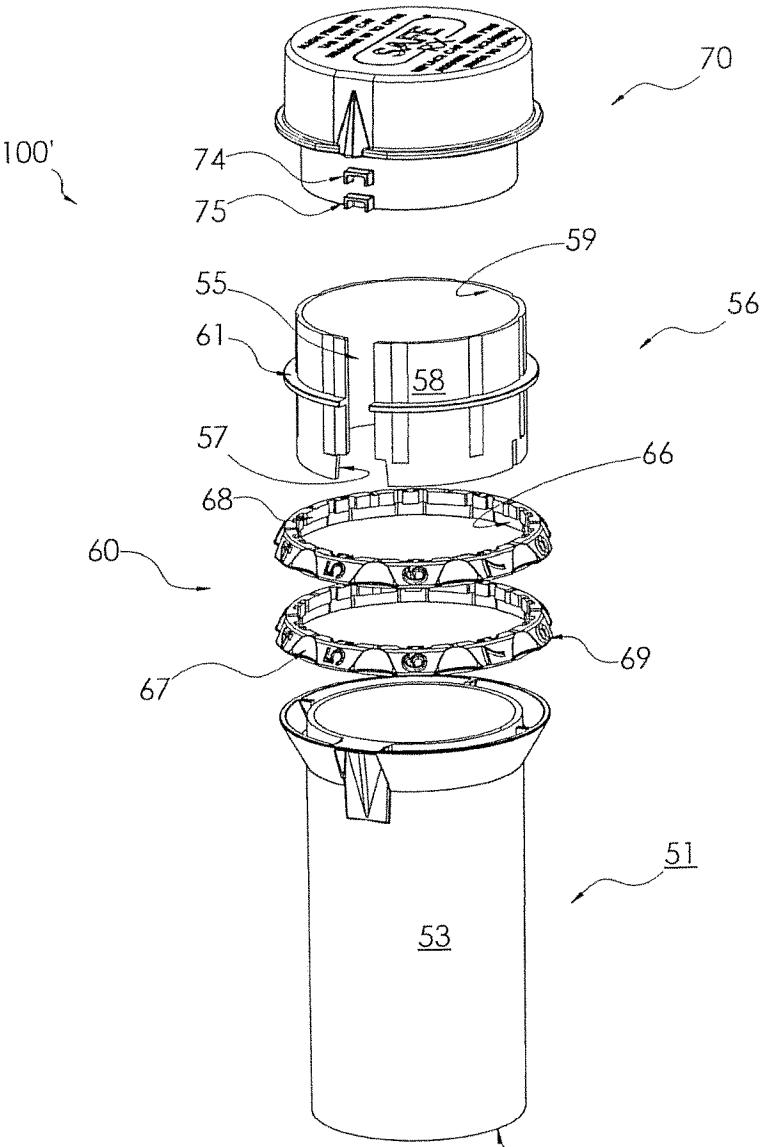
FIG. 6B shows an exploded view of the second embodiment for the container shown in FIG. 6A in accordance with some embodiments of the present invention.

Referring to FIGS. 6A and 6B, respectively, isometric and exploded views of a second embodiment of a locking programmable container 100' are shown. In the second embodiment, the locking programmable container 100' may include a first element 50, a plurality of rotatable rings 60, and a second element 70. Preferably, the first element 50 may include a cylindrical member 56 and a retainer 51. Advantageously, for this second embodiment, the multi-piece (i.e., two-piece) first element 50 may be structured and arranged to be used as the canister of the container 100'. While any number of rotatable rings 60 may be used, two rings 60 are shown in the figures and are preferred. In this variation, the rotatable rings 60 may be adapted for use on the canister portion of the container 100'.

As shown in FIG. 6B, the rotatable rings 60 may be annular, having an inner surface 66 and an outer surface 67.

In some implementations, a plurality of removable tabs 68 may be formed on the inner surface 66 of each ring 60, while an alphanumeric character 69 may be located on the outer surface 67 of each ring 60. The alphanumerical characters 69 enable the consumer, pharmacist, or authorized third party to create a multi-digit (e.g., a two-digit) combination code for the purpose of locking and selectively unlocking the container 100' (by re-entering the appropriate combination code). Preferably, the size and location of each alphanumerical character 69 on the outer surface 67 of the ring 60 corresponds to the size and location of a discrete tab 68 formed on the inner surface 66 of the ring 60. The inner diameter of the ring 60 may be designed or selected so that, once the rings 60 are placed on the cylindrical member 56 of the first element 50, the rings 60, and especially the removable tabs 68 on the inner surface 66 of each ring 60, will rotate smoothly about the circumferential surface or periphery of the cylindrical member 56 of the first element 50.

Figure 8:
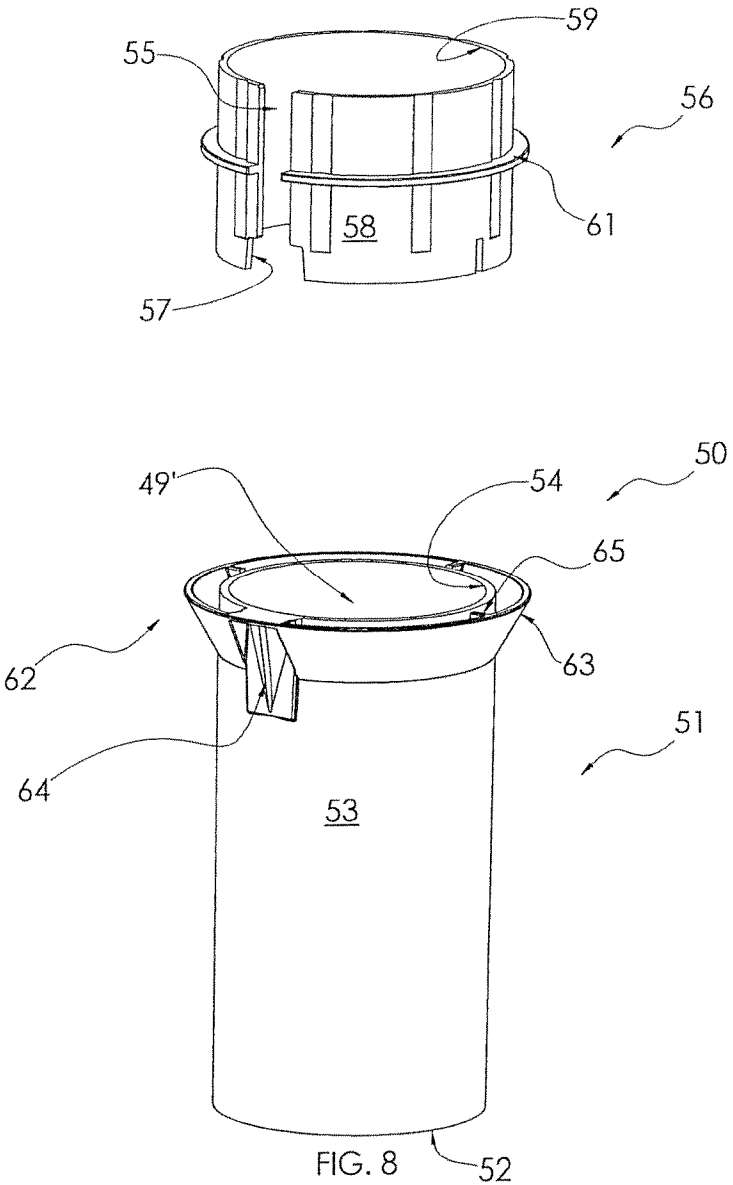
FIG. 8 shows an exploded view of the first element for the container shown in FIG. 7 in accordance with some embodiments of the present invention.
Figure 7:
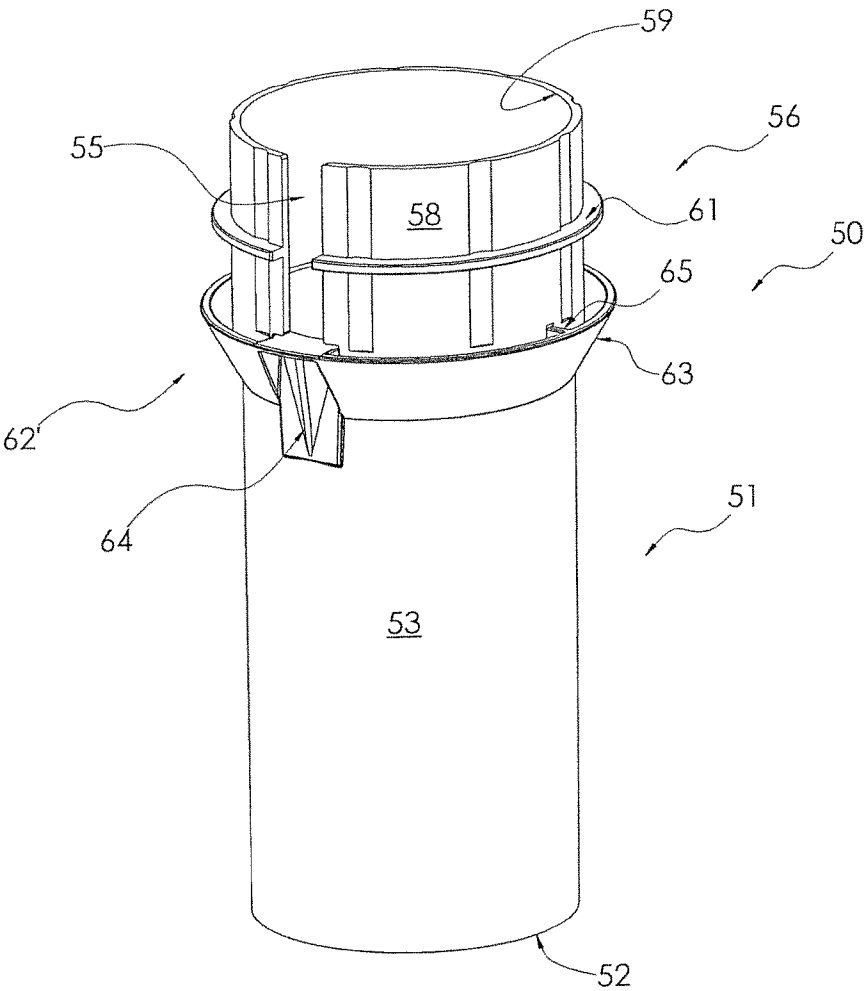
FIG. 7 shows an isometric view of the first element for the container shown in FIG. 6A in accordance with some embodiments of the present invention.

FIGS. 7 and 8 show, respectively, isometric and exploded views of an illustrative first element 50 that functions as the canister of a container 100' in accordance with the second embodiment of the present invention. According to the second embodiment, the first element 50 may include a retainer 51 and a cylindrical member 56. The height of the retainer 51 may be the same, substantially the same, or greater than the height of the cylindrical member 56. The retainer 51 may be manufactured (e.g., by extrusion, molding, 3D-printing, casting, and the like) from, for example, plastic, metals, composites, and the like, while the cylindrical member 56 may be manufactured (e.g., by extrusion, molding, 3D-printing, casting, and the like) from, for example, plastic, metals, composites, and the like. In some implementations, the retainer 51 may be fixedly attached to the cylindrical member 56 adhesively, by ultrasonic welding, by solvent bonding, and the like. Optionally, a plurality of notches, such as the notches shown in connection with the cylindrical member 26 (e.g., shown in FIG. 3) may also be provided on the cylindrical member 56.

In some applications, the retainer 51 may include a fully closed first end 52 and an open second end 54. A (e.g., annular) sidewall 53 may extend perpendicularly or substantially perpendicularly from the closed first end 52 towards the open second end 54. The hollow portion of the retainer 51 created by the sidewall 53 may provide a plenum 49' for storage of the contents of the container 100'. Although the embodied retainer 51 is shown as having a cylindrical or substantially cylindrical shape, that is done for illustrative purposes only. In any of its various implementations, portions of the retainer 51 may take on any practical structural or aesthetic shape.

In some implementations, a belled portion 62, having a projecting sidewall 63 that projects out and away from the sidewall 53 of the retainer 51, may be formed to project out from the sidewall 53 of the first element 50, e.g., at, close to, near, or proximate the open second end 54 of the retainer 51. The belled portion 62 may serve as or provide a blocking function to prevent unauthorized personnel from looking between the first element 50 and the second element 70 to try to align the open or empty spaces, corresponding to where tabs 38 have been removed, on the inner surface 66 of the rotatable rings 60 within the unlocking opening 55. As an alternative to a belled portion 62, if the shape and size of the sidewall 53 are large enough, the sidewall shape may serve as or provide the blocking function. Alignment indicia 64 (e.g., an arrow, a line, a triangle, and the like) may be formed on the sidewall 53 and/or on the belled portion 62 for the purpose of aligning the first element 50 with the second element 70 to lock and selectively unlock the container 100'.

As shown in FIG. 6B, in some embodiments, the cylindrical member 56 may include an annular sidewall 58 having a first opening 57 (e.g., at a distal end thereof) and a second opening 59 (e.g., at an opposing, proximal end thereof). A flange 61 may be formed on the sidewall 58. In some variations, the flange 61 may be formed midway or approximately midway between the first opening 57 and the second opening 59. Advantageously, the flange 61 may be provided to retain the rotatable rings 60 on the cylindrical member 56 and to prevent the second element 70 from interfering with rotation of the rings 60. An unlocking opening 55 may be structured and arranged to bisect the cylindrical member 56, extending (e.g., in a longitudinal or axial direction) from the second opening 59, through the flange 61, to the first opening 57 of the cylindrical member 56. The width of the unlocking opening 55 may be designed or selected to be slightly larger than the circumferential dimension of projections 74, 75 formed on the second element 70 and used to lock the first element 50 and the second element 70, so that, when an appropriate combination code has been dialed up (e.g., entered) on the rotatable rings 60, the projections 74, 75 may slide unhindered into the unlocking opening 55 of the cylindrical member 56. The width of the unlocking opening 55 may have a constant dimension; alternatively, the width of the unlocking opening 55 may taper slightly towards the first opening 57.

Alternatively, as shown in FIG. 6C, in some embodiments, the cylindrical member 56' may include an annular sidewall 58 having a first opening 57 (e.g., at a distal end thereof) and a second opening 59 (e.g., at an opposing, proximal end thereof). A flange 61' may be formed on the sidewall 58 at, near, or proximate the second opening 59 of the cylindrical member 56'. Advantageously, the flange 61' may be provided to retain the rotatable rings 60 on the cylindrical member 56 and also to prevent the second element 70 from interfering with the rotation of the rings 60. An unlocking opening 55' may be structured and arranged to extend (e.g., in a longitudinal or axial direction) from the second opening 59, through the flange 61', to the first opening 57 of the cylindrical member 56'. The width of the unlocking opening 55' may be designed or selected to be slightly larger than the circumferential dimension of projections 74, 75 formed on the second element 70 and used to lock the first element 50 and the second element 70, so that, when an appropriate combination code has been dialed up (e.g., entered) on the rotatable rings 60, the projections 74, 75 may slide unhindered into the unlocking opening 55' of the cylindrical member 56'. The width of the unlocking opening 55' may have a constant dimension; alternatively, the width of the unlocking opening 55' may taper slightly towards the first opening 57. Although the unlocking opening 55' may also be adapted to bisect the sidewall 58 of the cylindrical member 56', as shown in FIG. 6C, the length of the unlocking opening 55' may only extend up some portion of the height of the sidewall 58.

Figure 9:
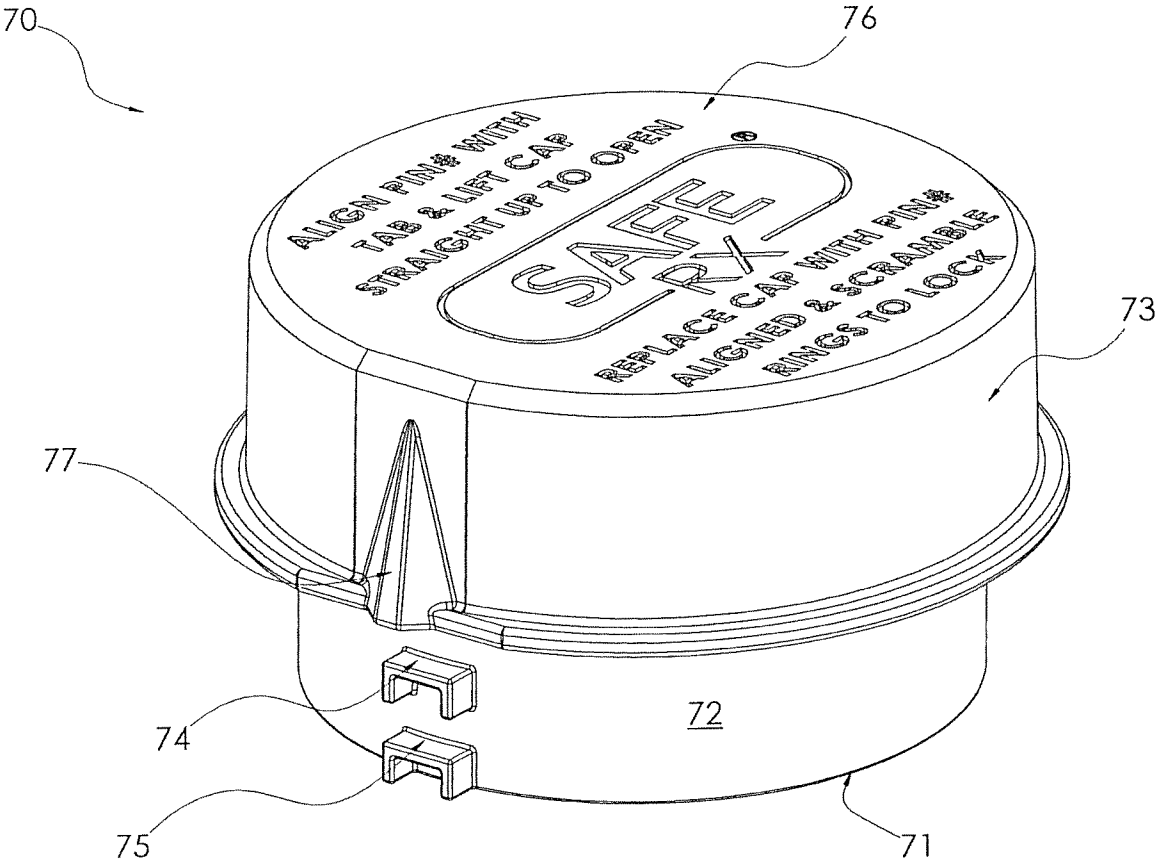
FIG. 9 shows an isometric view of a second element for the container shown in FIG. 6A in accordance with some embodiments of the present invention.

Referring to FIG. 9, an illustrative embodiment of a second element 70 for use with a first element 50 and rotatable rings 60 in connection with a locking programmable container 100' is shown. Although the embodied second element 70 is shown as having an annular shape, this is done for illustrative purposes only. Optionally, the second element 70 may have a belled or mushroom shape. The second element 70, which in the second embodiment may function as a cap to the canister of the container 100' may take on any practical structural or aesthetic shape. Advantageously, the annular, belled, and mushroom shapes may serve a blocking function to prevent unauthorized personnel from observing the location where the tabs to the combination code have removed.

In some embodiments, the second element 70 may include an open first end 71, a (e.g., cylindrical) sidewall 72, and a top portion 73 that includes a completely closed second end 76. Preferably, the outer diameter of the sidewall 72 may be designed to be slightly less than the inner diameter of the second opening 59 of the cylindrical member 56, 56' of the first element 50, so that the second element 70 may slip or slide, without excessive frictional resistance, within the second opening 59 of the cylindrical member 56, 56' of the first element 50.

In some variations, a plurality of projections 74, 75 may be formed on the sidewall 72 of the second element 70. Preferably, the number of projections 74, 75 may correspond to the number of rotatable rings 60 retained on the cylindrical member 56, 56'; hence, for the two-ring container 100' shown in FIGS. 6A and 6B, the total number of projections 74, 75 is two. In some embodiments, the projections 74, 75 may be cubical or substantially cubical in shape. In other embodiments, the projections 74, 75 may be C-shaped (as shown), I-shaped, or a combination thereof. Because the top portion 73 of the second element 70 is annular, belled, or mushroom-shaped, an additional (e.g., blocker) protrusion may not be not necessary, as the top portion 73 may be designed to extend sufficiently beyond the outer surface of the sidewall 72 to cover the second opening 59 and unlocking opening 55, 55' of the cylindrical member 56, 56' of the first element 50. An optional additional (e.g., blocker) protrusion, however, may be formed on the outer surface of the sidewall 72 for that purpose.

A portion of the projections 74, 75 may be provided to (e.g., structurally) engage tabs 68 disposed on the inner surface 66 of the rotatable rings 60 to securely lock the first element 50 to the second element 70 until the appropriate combination code has been dialed up (e.g., entered) on the rotatable rings 60. Once the appropriate combination code has been dialed up (e.g., entered) on the rotatable rings 60, the open or empty spaces resulting after the corresponding tabs 68 were removed should be properly aligned at the unlocking opening 55, 55', so that the cylindrical sidewall 72 and the second element 70 may be slidingly removed from within the second opening 59 of the cylindrical member 56, 56' of the first element 50.

Alignment indicia 77 (e.g., an arrow, a triangle, a line, and the like) may also be formed on the top portion 73 of the second element 40. In some variations, once the sidewall 72 of the second element 70 is (e.g., slidingly) inserted into the second opening 59 of the cylindrical member 56, 56' of the first element 50, such that the projections 74, 75 and the unlocking opening 55, 55' are aligned for either locking or unlocking the container 100', the alignment indicia 78 on the sidewall 53 of the retainer 51 of the first element 50 and the alignment indicia 77 on the top portion 73 of the second element 70 may themselves be aligned. Scrambling or rotating the rings 60 from this alignment position should result in securely locking the container 100', preventing unauthorized personnel from accessing the contents of the container 100'. In order to unlock the container 100' to access the contents, the consumer, pharmacist, or authorized third party may merely rotate the rings 60 to dial up the appropriate combination code between the alignment indicia 77, 78 on the retainer 51 of the first element 50 and the top portion 73 of the second element 70.

Figure 10A:
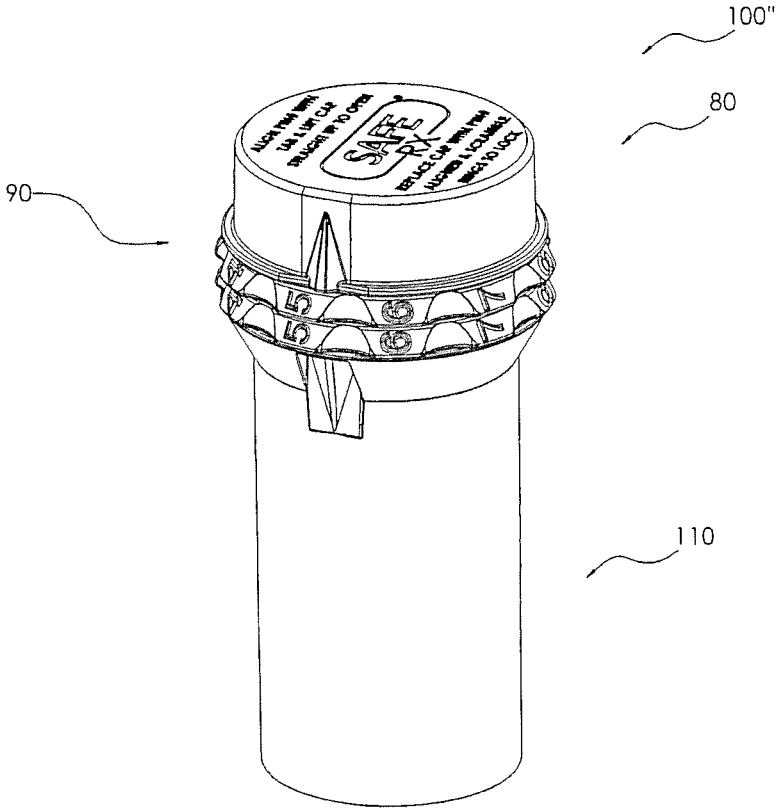
FIG. 10A shows an isometric view of a third embodiment for a container in accordance with some embodiments of the present invention.
Figure 10B:
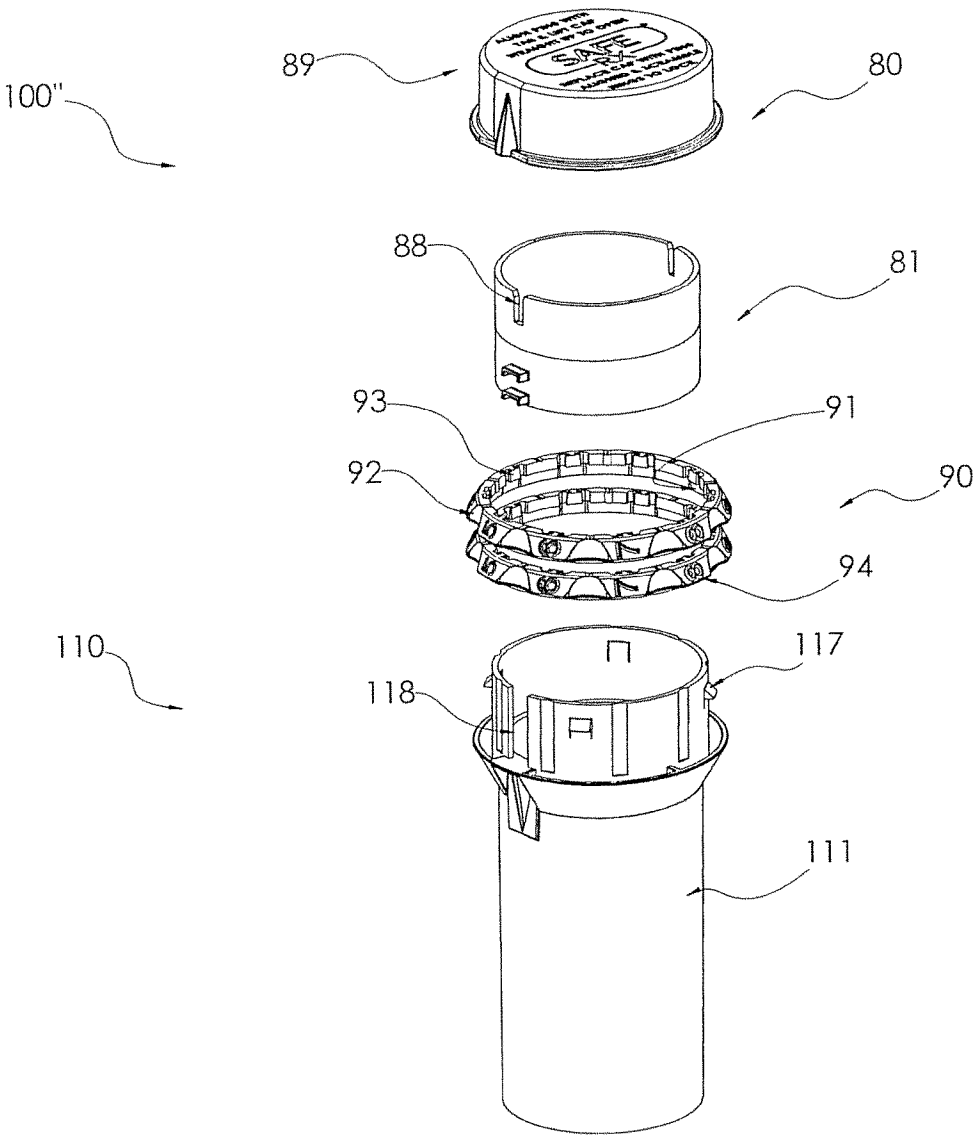
FIG. 10B shows an exploded view of the third embodiment shown in FIG. 10A in accordance with some embodiments of the present invention.

Referring to FIGS. 10A and 10B, isometric and exploded views of a third embodiment of a locking programmable container 100", respectively, are shown. In some embodiments, the locking programmable container 100" may include a first element 80, a plurality of rotatable rings 90, and a second element 110. While any number of rotatable rings 90 may be used, two rings 90 are shown in the figures and are preferred. In this variation, the rotatable rings 90 may be adapted for use on the canister portion of the container 100".

As shown in FIG. 10B, the rotatable rings 90 may be annular, having an inner surface 91 and an outer surface 92. In some implementations, a plurality of removable tabs 93 may be formed on the inner surface 91 of each ring 90, while an alphanumeric character 94 may be located on the outer surface 92 of each ring 90. The alphanumerical characters 94 enable the consumer, pharmacist, or authorized third party to create a multi-digit (e.g., a two-digit) combination code for the purpose of locking and selectively unlocking the container 100" (by re-entering the appropriate combination code). Preferably, the size and location of each alphanumerical character 94 on the outer surface 92 of the ring correspond to the size and location of a discrete tab 93 formed on the inner surface 91 of the ring 90. The inner diameter of each ring 90 may be designed or selected so that, once the rings 90 are placed on an upper sidewall portion 114 of the canister portion 110, the rings 90, and especially the tabs 93 on the inner surface 91 of the rings 90, will rotate smoothly about the circumferential surface or periphery of the upper sidewall portion 114. In some applications, a plurality of protrusions 117 formed on and about the upper sidewall portion 114 of the canister element 110 may be used to retain the rings 90 on the upper sidewall portion 114. Alternatively, a flange may be formed on the upper sidewall portion 114 to retain the rings 90 thereon.

Figure 11:
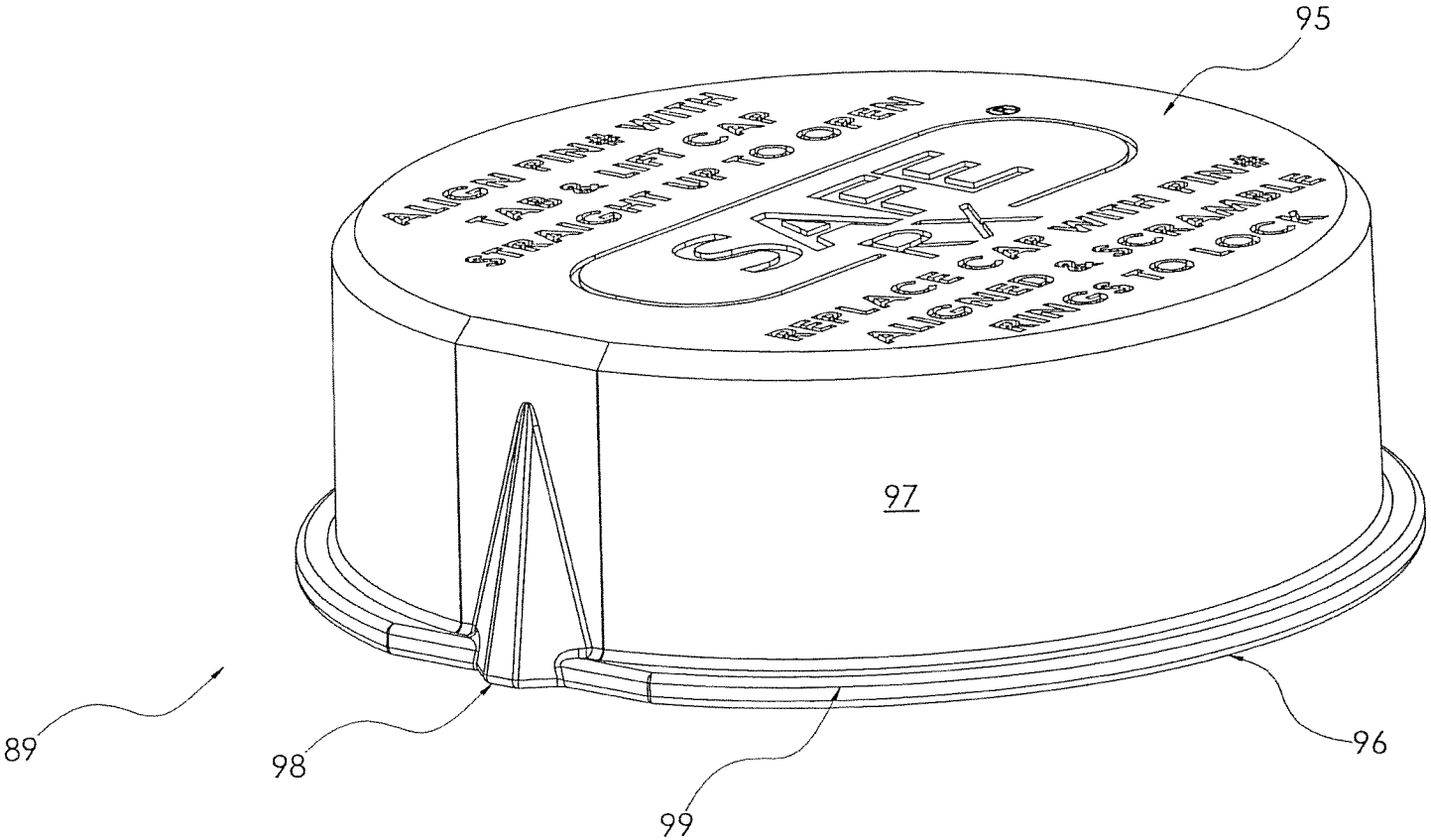
FIG. 11 shows a retainer for a cap element for the third embodiment in accordance with some embodiments of the present invention.
Figure 12:
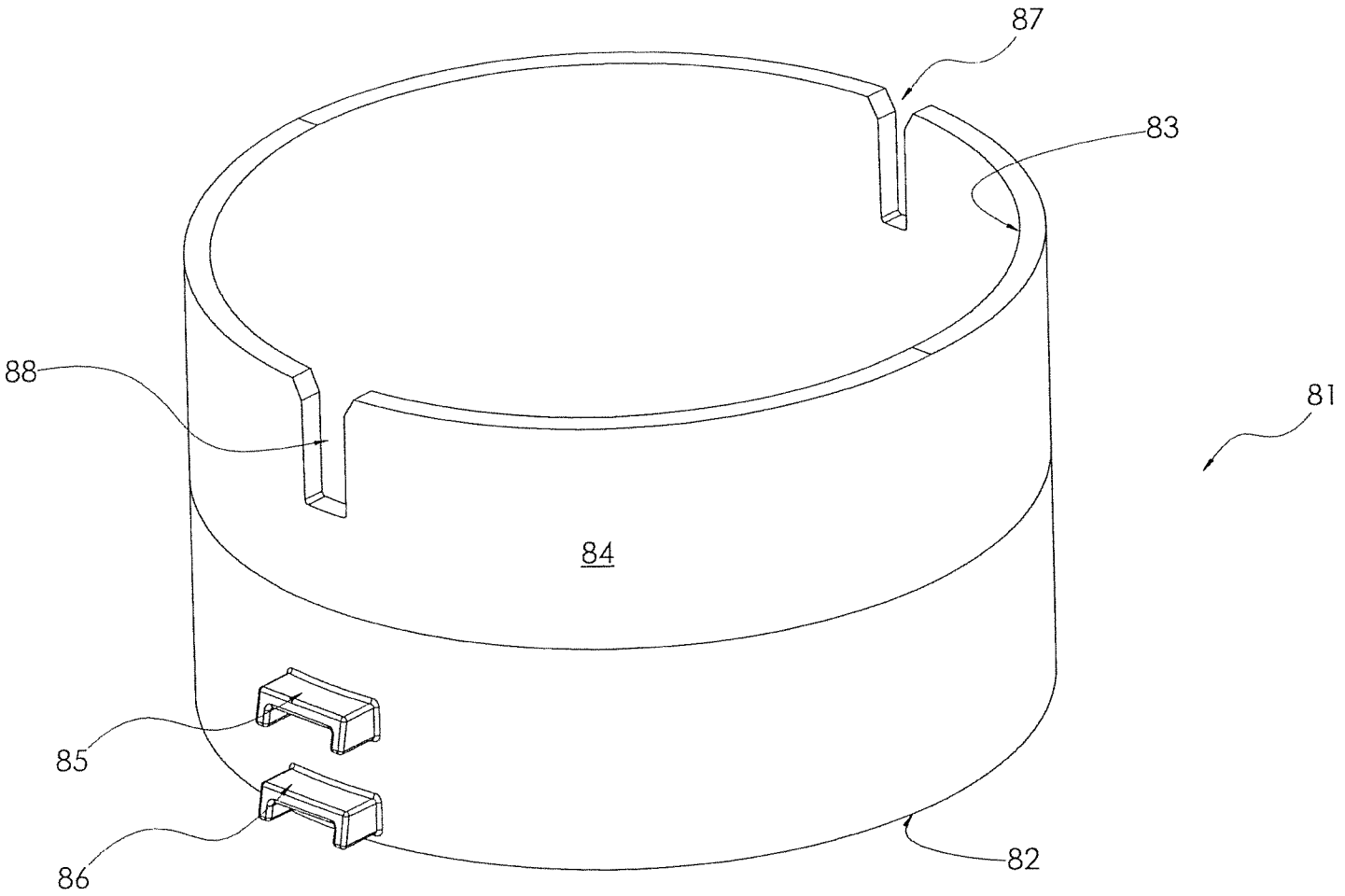
FIG. 12 shows a cylindrical member for the cap element for the third embodiment in accordance with some embodiments of the present invention.

FIGS. 11 and 12 show an illustrative cap element 80 that functions as the cap of a container 100" in accordance with the third embodiment of the present invention. According to the embodiment, the cap element 80 may include a retainer 89 (FIG. 11) and a cylindrical member 81 (FIG. 12). Preferably the height of the retainer 89 may be configured to have the same, substantially the same, or less than the height of the cylindrical member 81. The retainer 89 may be manufactured (e.g., by extrusion, molding, 3D-printing, casting, and the like) from, for example, plastic, metals, composites, and the like, while the cylindrical member 81 may be manufactured (e.g., by extrusion, molding, 3D-printing, casting, and the like) from, for example, plastic, metals, composites, and the like. In some implementations, the retainer 89 may be fixedly attached to the cylindrical member 81 adhesively, by ultrasonic welding, by solvent bonding, and the like.

In some applications, the retainer 89 may include a fully closed first end 95 and an open second end 96. A (e.g., annular) sidewall 97 may extend perpendicularly or substantially perpendicularly from the closed first end 95 to the open second end 96. Although the embodied retainer 89 is shown as having a cylindrical or substantially cylindrical shape, that is done for illustrative purposes only. In any of its various implementations, portions of the retainer 89 may take on any practical structural or aesthetic shape.

Alignment indicia 98 (e.g., an arrow, a line, a triangle, and the like) may be formed on the sidewall 97 for the purpose of aligning the cap element 80 with the canister element 110 to lock and selectively unlock the container 100". In some variations, a flange 99 may be formed on the sidewall 97 of the cap portion 89, e.g., at, near, close to, or proximate and/or about the open second end 96.

As shown in FIG. 12, in some embodiments, the cylindrical member 81 of the cap element 80 may include an annular sidewall 84 having a first opening 83 (e.g., at a distal end thereof) and a second opening 82 (e.g., at an opposing, proximal end thereof. Multiple notches 87, 88 may be formed in the sidewall 84 at the first opening 83, for example, for the purpose of fixedly attaching the retainer 89 to the cylindrical member 81. Although FIG. 12 shows a first notch 87 and a second notch 88, that is done for the purpose of illustration rather than limitation. More or fewer notches may be formed in the sidewall 84 of the cylindrical member 81. Moreover, although the first notch 87 and the second notch 88 shown in FIG. 12 appear to be diametrically opposed to one another, that is also done for the purpose of illustration rather than limitation. The first 87 and the second notch 88 may be formed on the sidewall 84 anywhere about the first opening 83. In some variations, the first notch 87 and second notch 88 may be mateable with corresponding projections, protrusions, or the like formed on the inner surface of the sidewall 97 of the retainer 89 and may provide points of connection between the retainer 89 and the cylindrical member 81.

In some variations, a plurality of projections 85, 86 may be formed on the sidewall 84 of the cylindrical member 81 of the cap element 80. In some embodiments, the projections 85, 86 may be cubical or substantially cubical in shape, C-shaped (as shown), I-shaped, or a combination thereof. Preferably, the number of projections 85, 86 may correspond to the number of rotatable rings 90 disposed or disposable on the canister element 110; hence, for the two-ring container 100" shown in FIGS. 10A and 10B, the total number of projections 85, 86 is two. In some variations, however, an additional (e.g., blocker) protrusion may be formed on the sidewall 84 of the cylindrical member 81 to block the combination code from visual discovery. Because the retainer 89 of the cap element 80 includes a flange 99 that projects sufficiently from the sidewall 97, a blocker protrusion is not necessary, as the flange 99 may extend sufficiently beyond the outer peripheral surface of the sidewall 84 of the cylindrical member 81 to cover an unlocking opening 118 formed in the canister element 110.

A portion of the projections 85, 86 may be provided to (e.g., structurally) engage tabs 93 located on the inner surface 91 of the rotatable rings 90 to securely lock the cap element 80 to the canister element 110 until the appropriate combination code has been dialed up (e.g., entered) on the rotatable rings 90. Once the appropriate combination code has been dialed up (e.g., entered) on the rotatable rings 90, the open or empty spaces provided after the corresponding tabs were removed should be properly aligned at the unlocking opening 118, so that the cylindrical member 81 of the cap element 80 may be slidingly removed from within the unlocking opening 118 of the canister element 110.

Figure 13:
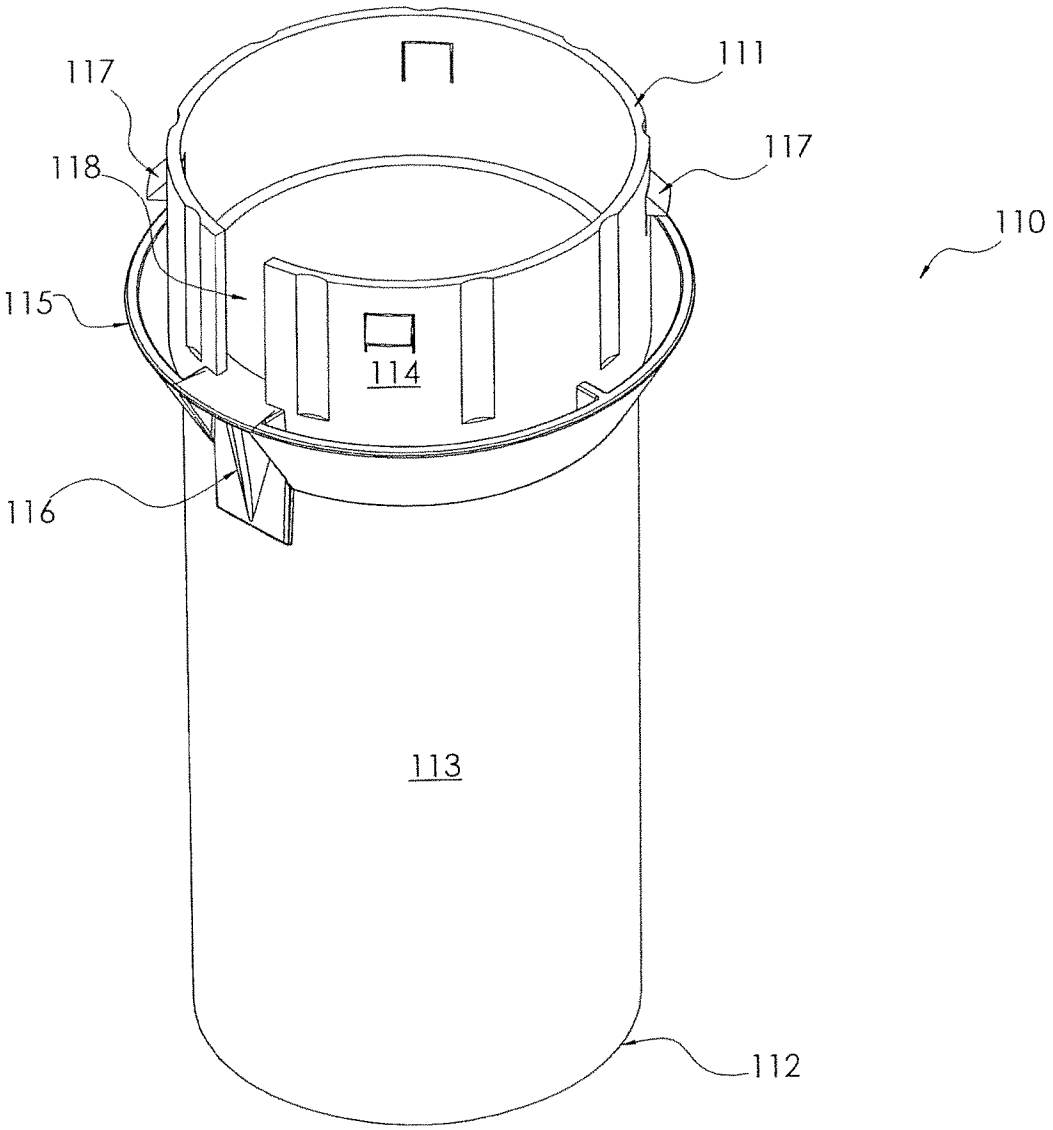
FIG. 13 shows a container element for the third embodiment in accordance with some embodiments of the present invention.

Referring to FIG. 13, an illustrative embodiment of a canister element 110 for use with the cap element 80 and rotatable rings 90 in connection with a locking programmable container 100" is shown. In some embodiments, the canister element 110 may include an open first end 111, an upper sidewall portion 114, a lower sidewall portion 113, and a completely closed second end 112. The canister element 110, which in the third embodiment may function as a canister for the container 100", may take on any practical structural or aesthetic shape. For example, as shown, in some applications, the canister element 110 may have a cylindrical or substantially cylindrical shape that, on the exterior surface of the sidewall 113, 114, is broken up by a projecting or belled portion 115. The projecting or belled portion 115 formed on the canister element 110 may serve as or provide a blocking function to prevent unauthorized personnel from visually aligning the open or empty spaces resulting from removed tabs at or within the unlocking opening 118 to unlock the lockable container 100".

In some implementations, the upper sidewall portion 114 may be designed to provide a surface having a constant circumferential dimension for holding the rotatable rings 90. In some variations, however, the circumferential dimension may taper slightly towards the first open end 111 of the canister element 110. In order to retain the rotatable rings 90 on the upper sidewall portion 114, a plurality of (e.g., four) protrusions 117 may be formed in the upper sidewall portion 114. In placing the rings 90 on the canister element 110, force applied to the inner surface 91 of the rings 90 may force the protrusions 117 to displace radially towards the plenum of the canister element 110. Once the ring 90 has passed over the protrusions 117, the protrusions 117 may return to their original locations. Preferably, the inner diameter of the upper sidewall portion 114 may be designed or selected to be slightly greater than the outer diameter of the second opening 82 of the cylindrical member 81 of the cap element 80, so that the cap element 80 may slide, without excessive frictional resistance, within the first opening 111 of the canister element 110.

In order to set a combination code and, subsequently, to lock and selectively unlock the cap element 80 and the canister element 110, an unlocking opening 118 may be formed in the upper sidewall portion 114 of the canister element 110. Preferably, the unlocking opening 118 may be structured and arranged to extend (e.g., in a longitudinal or axial direction) from the first opening 111 towards the lower sidewall portion 113. More preferably, the unlocking opening 118 may be structured and arranged to extend from the first opening 111 to a location in the upper sidewall portion 114 that just permits the consumer, pharmacist, or other authorized third party to access (as is described in greater detail below) the corresponding tabs 93, so as to allow the consumer, pharmacist, or other authorized third party to remove the tabs 93 corresponding to the combination code from the inner surfaces 91 of the rotatable rings 90. The width of the unlocking opening 118 should be designed to be slightly larger than the circumferential dimension of the projections 85, 86 used to lock the cap element 80 and the canister element 110, so that, when an appropriate combination code has been dialed up (e.g., entered) on the rotatable rings 90, projections 85, 86 formed on the cap element 80 may slide unhindered into the first opening 111 of the canister element 110.

Alignment indicia 116 (e.g., an arrow, a triangle, a line, and the like) may also be formed, for example, on the lower sidewall portion 113 and/or the belled portion 115 of the canister element 110, so as to align with the unlocking opening 118. In some variations, once the cylindrical member 81 of the cap element 80 is inserted into the first opening 111 of the canister element 110, such that the projections 85, 86 and the unlocking opening 118 are aligned for either locking or unlocking the container 100", the alignment indicia 98 on the sidewall 97 of the retainer 89 of the cap element 80 and the alignment indicia 116 on the canister element 110 may themselves be aligned. Scrambling or rotating the rings 90 from this alignment position should result in securely locking the container 100", preventing unauthorized personnel from accessing the contents of the container 100". In order to unlock the container 100" to access the contents, the consumer, pharmacist, or authorized third party may merely rotate the rings 90 to dial up the appropriate combination code between the alignment indicia 98 on the retainer 89 of the cap element 80 and the alignment indicia 116 on the canister element 110.

Figure 18A:
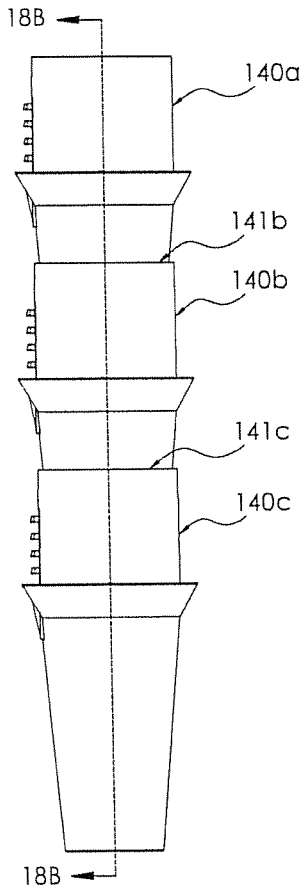
FIG. 18A shows a side view of a stack of nested canisters in accordance with some embodiments of the present invention.
Figure 18B:
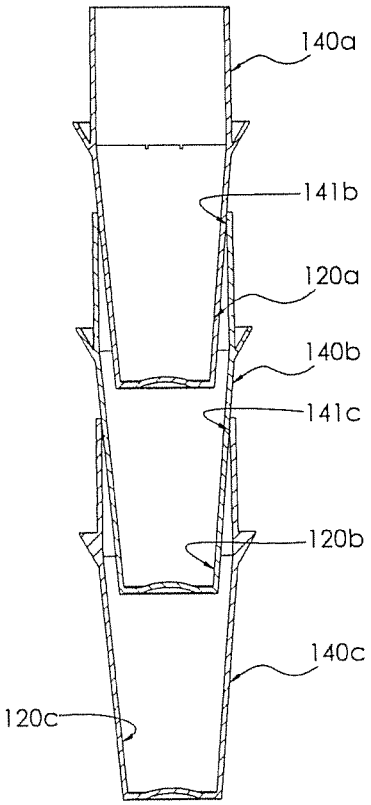
FIG. 18B shows a cross-section of the nested canisters taken along the 18B-18B axis shown in FIG. 18A in accordance with some embodiments of the present invention.

Costs associated with the shipment of lightweight canisters and containers may far exceed the costs of manufacturing, increasing the total cost of the canisters and containers. Advantageously, as shown in FIGS. 18A and 18B, in some embodiments, multiple canisters 140*a*, 140*b*, 140*c* may be stacked, one inside the other, to minimize the overall volume to be shipped. In some variations, bottom portions of each of the canisters 140*a*, 140*b*, 140*c* may be tapered 120*a*, 120*b*, 120*c*, so that the tapered portion 120*a* of a first canister 140*a* is able to be slidingly inserted through a first opening 141*b* of a second canister 140*b*, while the tapered portion 120*b* of the second canister 140*b* is able to be slidingly inserted through a first opening 141*c* of a third canister 140*c*, and so forth. Although only three canisters 140*a*, 140*b*, 140*c* are shown in FIGS. 18A and 18B, this is done for the purpose of illustration rather than limitation. In some variations, the tapered portions 120*a*, 120*b*, 120*c* of the canisters 140*a*, 140*b*, 140*c* may be tapered at an angle less than about ten (10) degrees, e.g., between about five (5) degrees and about ten (10) degrees. In other variations, the tapered portions 120*a*, 120*b*, 120*c* of the canisters 140*a*, 140*b*, 140*c* may be tapered at an angle greater than about ten (10) degrees.

Having described various embodiments of a locking programmable container, a method of establishing a combination code and of opening and/or securing a first element to a second element of a locking container will be described. In order to lock and unlock the container, a combination code must be dialed in (e.g., entered) on the rotatable rings, such that the alphanumerical characters, on the plurality of rings and that make up the combination code, are aligned within an alignment axis defined by alignment indicia formed on the first element and alignment indicia formed on the second element and, moreover, the alphanumerical characters are aligned with an unlocking opening formed, for example, in the cylindrical member of the first element.

Recall that each ring may include a plurality of alphanumerical characters on its outer surface and a corresponding plurality of removable tabs on its inner surface. Thus, a discrete tab on the inner surface of the ring may correspond to a discrete alphanumerical character on the outer surface of the ring. The interaction between or engagement of the tabs on the inner surface of the rotatable rings, which are disposed on the first element, and a plurality of projections, which are disposed on the second element, provide the locking mechanism that secures the first element to the second element. In short, the rings, tabs, and projections, in combination, may create a programmable locking container that requires a combination code to secure and to selectively open the container. Advantageously, if R represents the number of rings and n represents the number of alphanumerical characters (and hence the number of tabs) on each ring, then the number of possible combination codes (C) for the locking container may be determined by the equation:

$$C=R^n.$$

Thus, for two rings (i.e., n=2) and ten alphanumerical characters (i.e., R=10) per ring, there would be 100 possible combination codes (C). Increasing the number of rings (R) and/or increasing the number of alphanumerical characters (n) provide a greater number of possible combination codes.

Once the tabs corresponding to the digits of the combination code have been removed from the inner surfaces of each rotatable ring, the void, empty space, or opening left in place of the removed tab is not able to interact with the projections. As a result, when the alphanumerical characters corresponding to the tab openings are aligned between the alignment indicia on the first element and the alignment indicia on the second element, the void or empty tab openings is no longer present to obstruct movement of the projections as the second element is slidingly removed from inside of the cylindrical member of the first element.

The selective removal of tabs and the creation of a combination code can be performed at the time of manufacture (e.g., by the manufacturer) or, alternatively, the combination code may be created by the consumer, the pharmacist, or some other authorized third party. The creation process requires, first, determining what the combination code will be and then, with the first element removed from the second element, dialing in (i.e., entering) the appropriate combination code of the rings, such that the combination code is aligned with the alignment indicia on the retainer of the first element.

Aligning the combination code within the alignment position defined by the alignment indicia on the retainer of the first element and the alignment indicia on the second element ensures that the corresponding tabs for the combination code are aligned and exposed within the unlocking opening on the cylindrical member of the first element. The exposed tabs may then be removed, e.g., using a sharp instrument (e.g., a penknife, a safety razor blade, an X-ACTO® knife, nail clippers, and the like).

Figure 14:
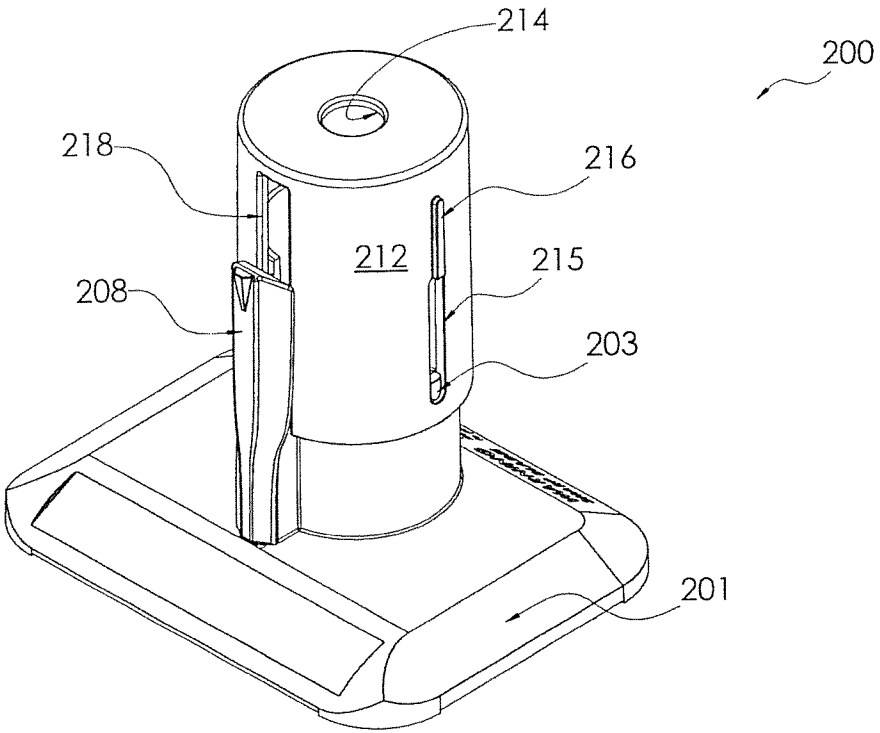
FIG. 14 shows an isometric view of a first embodiment of an encoder in accordance with some embodiments of the present invention.
Figure 15:
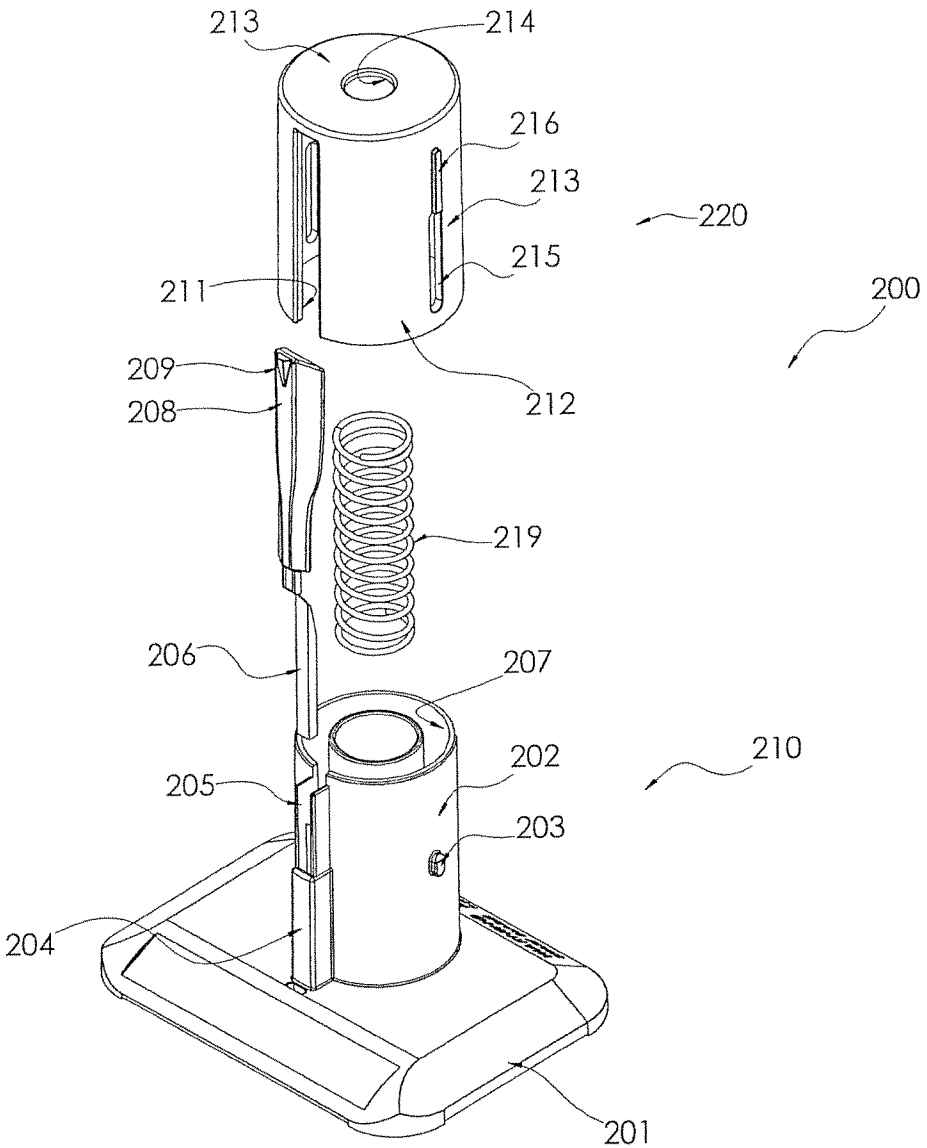
FIG. 15 shows an exploded view of the encoder shown in FIG. 14 in accordance with some embodiments of the present invention.

Alternatively, the consumer, pharmacist, authorized third party, and the like may use an encoder 200 to set the combination code for a locking container 100. Referring to FIGS. 14 and 15, an illustrative first embodiment of an encoding device or encoder 200 for programming a combination code in the rotatable rings disposed on the first element of a locking container is shown. In some embodiments, the encoder 200 may include a base portion 210 and a plunger portion 220. In some implementations, the base portion 210 of the encoder 200 may be configured to include a base element 201 (e.g., to provide support and stability) to which a post portion 202 is fixedly attached (e.g., via unitary construction). In some variations, the post portion 202 may be structured and arranged to be a hollow cylinder having a first, closed end at a proximal end thereof (e.g., at the base element 201) and a second, open end 207 at a distal end thereof. In some variations, the post portion 202 may include a plurality of concentric, coaxial hollow cylinders. The second, open end 207, as well as the inner plenum of the hollow cylinder, may be designed and dimensioned to accommodate a biasing element 219 (e.g., a spring) within the inner plenum of the hollow post portion 202.

A pair of retaining projections 203 may be formed on the sidewall of the post portion 202. Preferably, the retaining projections 203 may be configured to be diametrically opposed to one another on the sidewall of the post portion 202. Furthermore, on the sidewall of the post portion 202, for example, equidistant from the retaining projections 203, an upper projection 205 and a lower projection 204 may be formed. In some applications, the upper projection 205 may be structured and arranged to fixedly retain a cutting element 206 for cutting the removable tabs 38. Preferably, the width dimension of the upper projection 205 is designed to pass through the unlocking opening 35 in the cylindrical member 26 of the first element 20 without significant frictional resistance.

To cover the cutting element 206 (e.g., to prevent injury from an otherwise exposed cutting element 206), a cantilevered element 208 may be provided. In some implementations, the cantilevered element 208 may be rotatably attached to the base element 201 near, close to, or proximate where the lower projection 204 joins the base element 201, such that the cantilevered element 208 may flex out and away from the upper projection 205 and the cutting element 206 during the encoding process. In some variations, alignment indicia 209 may be formed at a distal end of the cantilevered element 208 for use in aligning the first element 20 and, more particularly, the unlocking opening 35 on the encoder 200.

In some embodiments, the plunger portion 220 may be configured as a hollow cylinder that includes an open first end 211, a partially closed second end 213, and a sidewall 212 disposed therebetween. Preferably, the inner diameter of the open first end 211 may be designed or selected to be slightly greater than the outer diameter of the post portion 202 of the base portion 210, so that the inner surface of the plunger portion 220 may translate over the outer surface of the post portion 210 without excessive frictional resistance. Optionally, an opening 214 may be formed in the partially closed second end 213. Advantageously, the optional opening 214 promotes a constant wall thickness during plastic injection molding and, also, enables users to view the biasing element 219 disposed within the post portion 202 of the base portion 210 and the plunger portion 220.

To accommodate the upper projection 205 and the lower projection 204, a longitudinal opening 218 may be configured or formed in the sidewall 212 of the plunger portion 220. A plurality (e.g., a pair) of longitudinal openings 215 for receiving the retaining projections 203 on the post portion 202 may also be provided or formed in the plunger portion 220. The openings 215 may be structured and arranged to cooperate with the pair of retaining projections 203 to slidingly connect the plunger portion 210 to the post portion 202 of the base portion 210. Preferably, the openings 215 may be configured to be diametrically opposed to one another on the sidewall 212 of the plunger portion 220. More preferably, the openings 215 may be designed or dimensioned to accommodate the necessary translation of the plunger portion 220 during the encoding process to produce the combination code on the rings 30.

In some applications, in order to properly position the first element 20 on the encoder 200 and/or to properly maintain the position of first element 20 during the encoding process, a plurality of (e.g., longitudinal or axial) ribs 216 may be provided about the sidewall 212 of the plunger portion 220. Advantageously, in some embodiments, the locations of the ribs 216 may be structured and arranged on the sidewall 212 so that the ribs 216 may be mateable with corresponding breaks 34 in the flange 31 of the cylindrical member 26 of the first element 20. Mating of the ribs 216 and the breaks 34 in the flange 31 may minimize the rotation of the first element 20 during the encoding process.

Having described a first embodiment of an encoding device 200, a process for encoding the rings 30 of the canister 100 using the encoding device 200 will now be described. In a first step, encoding the rings 30 disposed on the first element 20 includes dialing up (e.g., entering) the combination code on the alphanumerical characters 39 on the rings 30 disposed on the first element 20. Preferably, the desired combination code is aligned with alignment indicia formed on the first element 20. In a next step, the first element 20 with the desired combination code may be placed over and on the plunger portion 220. Advantageously, the ribs 216 on the plunger portion 220 and the breaks 34 in the flange 31 of the cylindrical member 26 of the first element 20 may facilitate placing and properly aligning the first element 20 on the plunger portion 220. In a next step, the user should ensure that the desired combination code is now properly aligned between the alignment indicia on the retainer 21 of the first element 20 and the alignment indicia 209 on the cantilevered element 208.

Once the user is comfortable with the combination code and its proper alignment on the encoding device 200, the user may apply an axial force to the closed end 22 of the retainer 21 of the first element 20 (e.g., by using the palm of the user's hand), compressing the biasing element 219 and driving the first element 20 and the plunger portion 220 downwards towards the base element 201. In some applications, as the first element 20 is driven downwards, the rings 30 may cause or force the cantilevered element 208 to flex out and away from the cutting element 206, while the upper projection 205 and the cutting element 206 slide into the unlocking opening 35 in the cylindrical member 26 of the first element 20, removing the tabs 38 associated with the alphanumerical characters 39 of the desired combination code.

Once the encoding is completed, the user may remove the load or force applied to the closed end 22 of the retainer 21 of the first element 20, allowing the biasing element 219 to return the plunger portion 220 to its initial (e.g., at rest) position. The first element 20 may then be removed from the plunger portion 220 and inspected to ensure that the tabs 38 associated with the combination code were completed removed from the inner surface 36 of the rings 30. The user may then want to ensure that the locking feature and the combination code work by, first, scrambling the rotating rings 30 and by, then, dialing up (i.e., entering) the appropriate combination code on the rings 30. Once the appropriate combination code is dialed up (e.g., entered), the user may again visually inspect the inner surfaces 36 of the rings 30 through the second opening 29 and the unlocking opening 35 in the cylindrical member 26 of the first element 20 to ensure that the void or empty space left by the removed tabs 38 appears within the unlocking opening 35. The verification process may also be repeated after the first element 20 and second element 40 have been joined and the rings 30 scrambled again.

Figure 17:
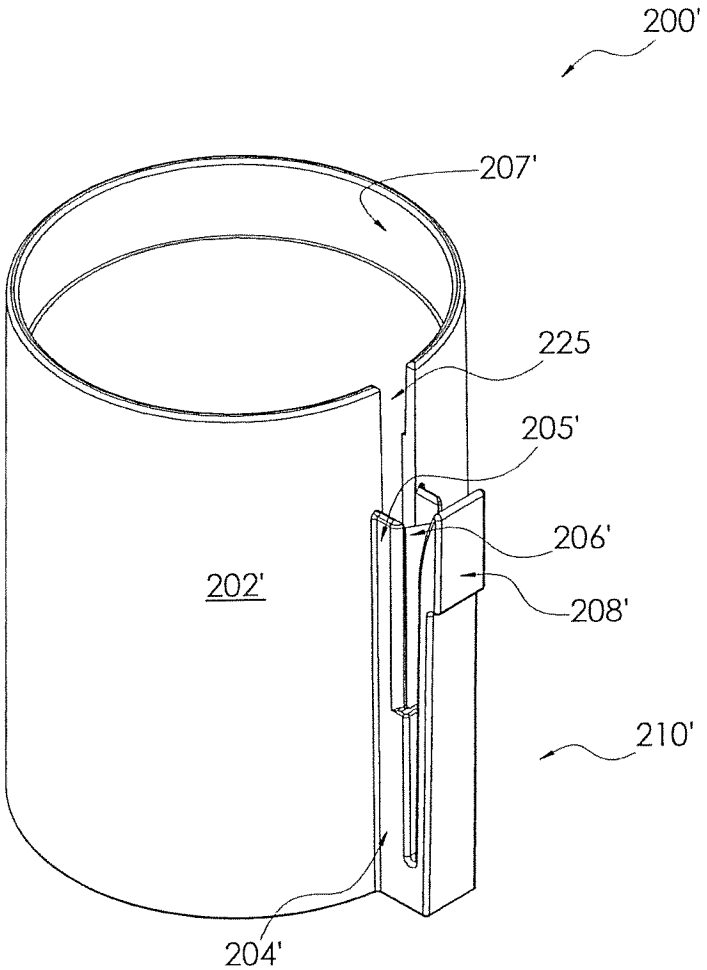
FIG. 17 shows an exploded view of the encoder shown in FIG. 16 in accordance with some embodiments of the present invention.
Figure 16:
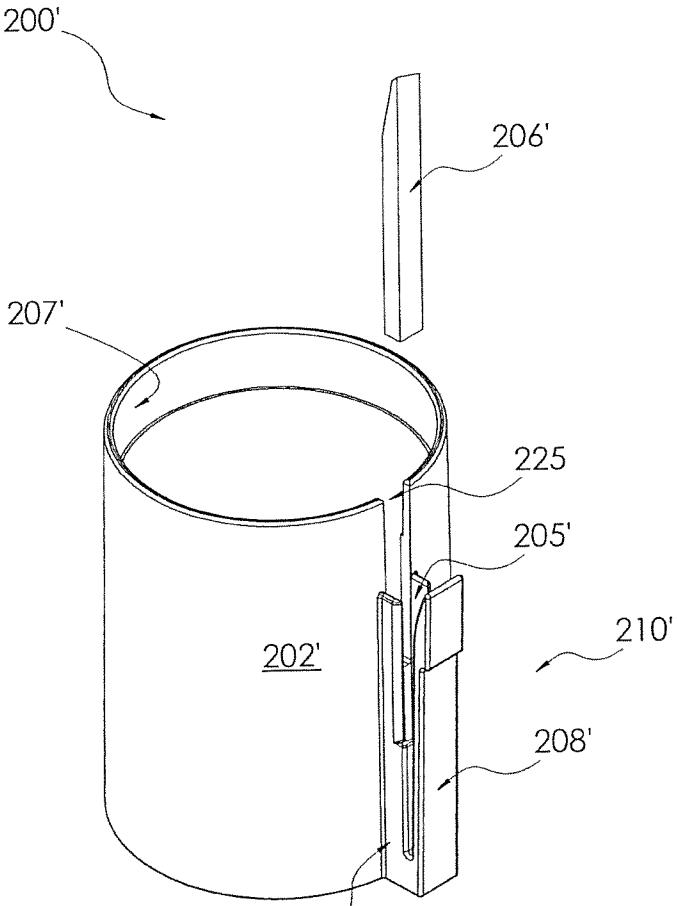
FIG. 16 shows an isometric view of a second embodiment of an encoder in accordance with some embodiments of the present invention.

Referring to FIGS. 16 and 17, a second embodiment of an encoding device or encoder 200' is shown. In some embodiments, the encoder 200' may be structured and arranged as a hollow or substantially hollow cylinder having a sidewall 202' and at least one open end 207'. The opposing end may be opened or closed or a combination of the two. In some applications, a cutting device 210' may be formed at, near, close to, or proximate an opening 225 in the sidewall 202' of the encoder 200'. In some variations, the cutting device 210' may include an upper projection 205', a lower projection 204', and a cantilevered element 208', which may be configured to operate as previously described in connection with the first embodied encoder 200. A cutting element 206' may be fixedly attached to the upper projection 205'.

Having described a second embodiment of an encoding device 200', a process for encoding the rings of the container 100 using the encoding device 200' will now be described. In a first step, encoding the rings 30 disposed on the first element 20 includes dialing up (e.g., entering) the combination code on alphanumerical characters 39 on the rings 30 disposed on the first element 20. Preferably, the desired combination code may be aligned with alignment indicia formed on the first element 20. In a next step, the first element 20 with the desired combination code may be placed over the open end 207' about the sidewall 202' of the encoder 200'. In a next step, the user should ensure that the desired combination code is now properly aligned between the alignment indicia on the retainer 21 of the first element 20 and the cantilevered element 208'.

Once the user is comfortable with the combination code and its proper alignment on the encoding device 200', the user may apply an axial force to the closed end 22 of the retainer 21 of the first element 20 (e.g., by using the palm of the user's hand), driving the first element 20 downwards. In some applications, as the first element 20 is driven downwards, the rings 30 may force or cause the cantilevered element 208' to flex out and away from the cutting element 206', while the upper projection 205' and the cutting element 206' slide into the unlocking opening 35 in the cylindrical member 26 of the first element 20, removing the tabs 38 associated with alphanumerical characters 39 of the desired combination code.

Once the encoding is completed, the user may remove the first element 20 from the encoder 200' and inspect it to ensure that the tabs 38 were completed removed from the inner surface 36 of the rings 30. The user may then want to ensure that the locking feature and the combination code work by, first, scrambling the rotating rings 30 and by, then, dialing up (i.e., entering) the appropriate combination code on the rings 30. Once the appropriate combination code is dialed up (e.g., entered), the user may again visually inspect the inner surfaces 36 of the rings 30 through the second opening 29 and the unlocking opening 35 in the cylindrical member 26 of the first element 20 to ensure that the void or empty space left by the removed tabs 38 appears within the unlocking opening 35. The verification process may also be repeated after the first element 20 and second element 40 have be joined and the rings 30 scrambled again.

The invention may be embodied in other specific forms without departing from the spirit or essential characteristics thereof. The foregoing embodiments, therefore, are to be considered in all respects illustrative rather than limiting the invention described herein. Scope of the invention is thus indicated by the appended claims, rather than by the foregoing description, and all changes that come within the meaning and range of equivalency of the claims are intended to be embraced therein.

What is claimed is:

1. A lockable container comprising:

a first element comprising:

a cylindrical member comprising an annular sidewall forming a first open end at a proximal end thereof and a second open end at a distal end thereof;

at least two rings rotatably supported by the annular ring of the cylindrical member; and a retainer for capturing the rings on the cylindrical member and covering the first open end, the retainer having an annular sidewall forming an open end slidingly engageable over the first open end of the cylindrical member of the first element; and a second element mateable with the first element and comprising:

a member comprising an annular sidewall forming an open end and a closed end and further comprising a plurality of projections formed on an exterior surface thereof, such that the projections cooperate with the rings to close the second open end of the cylindrical member of the first element to control access to an interior of the container and, wherein the open end of the member of the second element is slidingly engageable with the second open end of the cylindrical member of the first element.

2. The container of claim 1, wherein a height of the first element is greater than a height of the second element.

3. The container of claim 1, wherein a height of the first element is substantially equal to a height of the second element.

4. The container of claim 1, wherein a height of the first element is less than a height of the second element.

5. The container of claim 1, wherein the first element comprises a canister and the second element comprises a cap, such that the cap closes the second open end when the canister and cap are mated.

6. The container of claim 1, wherein the retainer is fixedly attached to the cylindrical member.

7. The container of claim 1, wherein the cylindrical member further comprises an annular flange formed at the second open end for retaining the rings.

8. The container of claim 1, wherein the rings are for setting a combination code for locking the cylindrical member to the second element, each ring comprising an outer peripheral surface and an inner peripheral surface, wherein a plurality of identification elements is formed on the outer peripheral surface and a plurality of corresponding selectively removable tabs are formed on the inner peripheral surface.

9. The container of claim 1, wherein the retainer further comprises:

a closed end formed at the proximal end; and an annular flange formed at the open end for retaining the rings.

10. The container of claim 1, wherein the second, closed end of the cylindrical member of the first element comprises a belled portion.

11. The container of claim 10, wherein a lower portion of the belled portion is structured and arranged to rest on an annular flange formed at the second open end of the cylindrical member.

12. The container of claim 11, wherein the projections are structured and arranged to slidingly pass through an unlocking opening formed in the cylindrical member when a combination code is selected on the rings.

13. The container of claim 1, wherein the first element comprises a cap and the second element comprises a canister, such that the cap covers an open end of the canister when the canister and the cap are mated.

14. The container of claim 1, wherein a first second element is structured and arranged to slidingly fit inside a second element of a second container.

15. A method of controlling access to contents within a lockable container, the method comprising:

providing a lockable container that comprises:

a first element comprising:

a cylindrical member comprising an annular sidewall forming a first open end at a proximal end thereof and a second open end at a distal end thereof;

at least two rings rotatably supported by the annular ring of the cylindrical member; and a retainer for capturing the rings on the cylindrical member and covering the first open end, the retainer having an annular sidewall forming an open end slidingly engageable over the first open end of the cylindrical member of the first element; and a second element mateable with the first element and comprising:

a member comprising an annular sidewall forming an open end and a closed end and further comprising a plurality of projections formed on an exterior surface thereof, such that the projections cooperate with the rings to close the second open end of the cylindrical member of the first element to control access to an interior of the container and, wherein the open end of the member of the second element is slidingly engageable with the second open end of the cylindrical member of the first element.

16. The method of claim 15 further comprising fixedly attaching the retainer to the cylindrical member.

17. The method of claim 15 further comprising forming a plurality of projections on an exterior surface of the second element.

18. The method of claim 17, wherein the projections are structured and arranged to slidingly pass through an unlocking opening formed in the cylindrical member when a combination code is selected on the rings.

19. The method of claim 15, wherein providing the retainer comprises forming a closed end at a proximal end of the annular sidewall.

20. The method of claim 17, further comprising forming an annular flange at the open end of the annular sidewall for retaining the rings.

21. The method of claim 15 further comprising forming an unlocking opening and a plurality of alignment openings in the cylindrical member.

22. The method of claim 15, wherein the rings are for setting a combination code for locking the cylindrical member to the second element, each ring comprising an outer peripheral surface and an inner peripheral surface, wherein a plurality of identification elements is formed on the outer peripheral surface and a plurality of selectively removable tabs are formed on the inner peripheral surface.

23. The method of claim 15 further comprising forming an annular flange on the second open end of the cylindrical member to retain the rings.

24. The method of claim 15, wherein the open end of the second element is structured and arranged to slidingly fit inside the cylindrical member of the first element.

* * * * *